US007951759B2

(12) United States Patent
Dieckmann et al.

(10) Patent No.: US 7,951,759 B2
(45) Date of Patent: May 31, 2011

(54) FISCHER-TROPSCH WAX COMPOSITION AND METHOD OF TRANSPORT

(75) Inventors: Gunther H. Dieckmann, Walnut Creek, CA (US); Mark R. Buetzow, Novato, CA (US); Dennis J. O'Rear, Petaluma, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 122 days.

(21) Appl. No.: 12/345,198

(22) Filed: Dec. 29, 2008

(65) Prior Publication Data

US 2009/0173662 A1 Jul. 9, 2009

Related U.S. Application Data

(62) Division of application No. 10/950,662, filed on Sep. 28, 2004, now Pat. No. 7,479,216.

(51) Int. Cl.
*C10M 159/06* (2006.01)

(52) U.S. Cl. ..... 508/450; 508/451; 508/583; 208/20; 208/21; 208/24

(58) Field of Classification Search ..... 508/583, 508/450, 451; 208/20, 21, 24
See application file for complete search history.

(56) References Cited

U.S. PATENT DOCUMENTS

| | | | | |
|---|---|---|---|---|
| 2,981,683 | A | 4/1961 | Simpson et al. | |
| 3,776,248 | A | 12/1973 | Titus | |
| 3,853,356 | A | 12/1974 | Merrill, Jr. | |
| 3,926,203 | A | 12/1975 | Marsden, Jr. et al. | |
| 4,050,742 | A | 9/1977 | Hughes et al. | |
| 4,287,902 | A | 9/1981 | McClaflin et al. | |
| 4,305,688 | A | 12/1981 | Savins | |
| 4,568,663 | A | 2/1986 | Mauldin | |
| 5,292,989 | A | 3/1994 | Davis | |
| 5,856,260 | A | 1/1999 | Mauldin | |
| 5,856,261 | A | 1/1999 | Culross et al. | |
| 5,863,856 | A | 1/1999 | Mauldin | |
| 5,866,751 | A | 2/1999 | Womack, Jr. et al. | |
| 5,945,459 | A | 8/1999 | Mauldin | |
| 5,968,991 | A | 10/1999 | Mauldin | |
| 6,294,076 | B1 * | 9/2001 | Genetti et al. | 208/24 |
| 6,313,361 | B1 * | 11/2001 | Waycuilis | 585/314 |
| 6,541,524 | B2 * | 4/2003 | O'Rear et al. | 518/700 |
| 6,677,388 | B2 * | 1/2004 | Chakrabarty et al. | 516/77 |
| 6,846,848 | B2 * | 1/2005 | Wittenbrink et al. | 518/700 |
| 7,261,810 | B2 * | 8/2007 | Argo et al. | 208/370 |

(Continued)

FOREIGN PATENT DOCUMENTS

| | | |
|---|---|---|
| EP | 0609079 | 8/1994 |

(Continued)

*Primary Examiner* — Ellen M McAvoy
(74) *Attorney, Agent, or Firm* — Merchant & Gould

(57) ABSTRACT

The present invention relates to transportable product for the transportation of paraffinic wax and methods of transporting using this transportable product. The transportable product comprises 90 to 20 weight % of a liquid comprising >50 weight % alcohol and having a true vapor pressure of ≦14.7 psia when measured at 20° C., and 10 to 80 weight % of wax particles, wherein the wax particles comprise ≧75 weight % of wax particles larger than 0.1 mm. The transportable product and methods of transporting according to the present invention are able to accommodate a relatively high weight % of paraffinic wax particles in the transportable product while avoiding interparticle adhesion and clumping by ensuring that the wax particles are not too small and the amount of small wax particles is not excessive.

20 Claims, 2 Drawing Sheets

U.S. PATENT DOCUMENTS

| | | | | |
|---|---|---|---|---|
| 7,479,216 | B2 * | 1/2009 | Dieckmann et al. | 208/18 |
| 7,488,411 | B2 * | 2/2009 | Dieckmann et al. | 208/21 |
| 7,501,019 | B2 * | 3/2009 | Dieckmann et al. | 106/502 |
| 7,754,065 | B2 * | 7/2010 | Dieckmann et al. | 208/24 |
| 7,754,066 | B2 * | 7/2010 | Dieckmann et al. | 208/24 |
| 2004/0068923 | A1 * | 4/2004 | O'Rear et al. | 44/436 |
| 2006/0065573 | A1 | 3/2006 | Dieckmann et al. | |
| 2006/0069296 | A1 | 3/2006 | Dieckmann et al. | |

FOREIGN PATENT DOCUMENTS

| | | |
|---|---|---|
| WO | 03/106346 | 12/2003 |
| WO | 03/106349 | 12/2003 |
| WO | 03/106351 | 12/2003 |
| WO | 03/106353 | 12/2003 |
| WO | 03/106354 | 12/2003 |

* cited by examiner

FISCHER-TROPSCH WAX COMPOSITION AND METHOD OF TRANSPORT

This application is a divisional of U.S. patent application Ser. No. 10/950,662, filed Sep. 28, 2004, the contents of which are hereby incorporated in their entirety.

FIELD OF THE INVENTION

The present invention relates to procedures and materials useful for the commercial transportation of a paraffinic wax from a remote site to a second site where the wax can be upgraded into finished products.

BACKGROUND OF THE INVENTION

Oil fields are typically found in remote locations. Crude oil is a mixture of hydrocarbonaceous compounds when it comes out of the ground. Typical maximum temperatures for conventional crude carriers are 140° F. (60° C.). Waxy crude oils must be shipped in specially equipped crude carriers at temperatures up to around 160° F. (71° C.). Slack waxes from petroleum deoiling and dewaxing operations must also be shipped in a molten state at elevated temperatures in specialty chemical tankers. Waxy crude oils and slack waxes that can be shipped in these specially equipped carriers or specialty tankers are typically required to have pour points at least 10° F. below the shipping temperature. Shipping crude oils and waxes with pour points at least 10° F. below the temperature of shipping in the specially equipped carrier or specialty tanker provides a measure of protection against an excessive amount of solid wax forming during the voyage. While some solid wax can be tolerated during unloading, formation of an excessive amount of solid wax requires a lengthy and costly operation to melt the solid wax. The use of conventional crude carriers, those that ship materials at temperatures at or below 140° F., is preferred whenever possible because these carriers have a significantly lower cost of transport.

Similarly, when crude oil is shipped in a pipeline, materials that are pumpable at near ambient conditions are preferred because these materials avoid the need for heated pipelines. Similar shipping considerations exist for transporting waxy crude oil in railcars and trucks. Materials that are pumpable at or near ambient conditions are preferred due to the significantly lower cost of transport.

Like crude oil, natural gas and coal assets are often located at remote sites. It is often more commercially feasible to convert these resources into synthesis gas and then into higher molecular weight hydrocarbons at the remote sites rather than attempting to transport the natural gas and coal assets to another location for conversion. Many processes, including Fischer-Tropsch synthesis, can be used to convert synthesis gas from methane or coal to higher molecular weight hydrocarbons. The products of Fischer-Tropsch synthesis are mostly linear hydrocarbons, these products often include a high melting point paraffinic wax. From the Fischer-Tropsch products, a $C_{5+}$ containing product stream, which is solid at room temperature, can be isolated. This product stream is commonly referred to as "syncrude."

When capital costs at the remote sites, where the natural gas and coal assets are located, are high, it is desirable to limit the amount of processing equipment at the remote locations. Accordingly, it is desirable to transport the syncrude to existing commercial refineries for upgrading to provide finished, salable products.

Since it is desirable to transport waxy petroleum crude and Fischer-Tropsch products, including Fischer-Tropsch syncrude, from remote sites to distant commercial refineries, there have been attempts to develop acceptable approaches for this transportation.

U.S. Pat. Nos. 5,968,991; 5,945,459; 5,863,856; 5,856,261; and 5,856,260 disclose a catalyst useful in Fischer-Tropsch reactions and products produced by these reactions. These patents further disclose that a liquid product of a Fischer-Tropsch reactor can be produced and shipped from a remote area to a refinery site for further chemical reacting and upgrading to a variety of products, or produced and upgraded at a refinery site.

There have been several approaches developed to transport the waxy Fischer-Tropsch product. One approach to shipping waxy Fischer-Tropsch products, as disclosed in U.S. Pat. No. 5,866,751, is to isolate $C_{20-36}$ waxy hydrocarbons from the Fischer-Tropsch products. U.S. Pat. No. 5,866,751 discloses transporting long-chain, non-volatile, solid paraffin wax hydrocarbons in the $C_{20-36}$ range in solid form from a remote site to a local site. However, transporting solids requires expensive forming, loading, and unloading facilities and thus, is difficult and expensive.

Another approach has focused on transporting a Fischer-Tropsch syncrude that has been partially upgraded to convert some of the linear hydrocarbons into iso-paraffins, as disclosed in U.S. Pat. No. 5,292,989. U.S. Pat. No. 5,292,989 discloses that to achieve a pumpable product, the Fischer-Tropsch wax is isomerized to convert some of the normal paraffins to branched paraffins. Isomerization provides a syncrude that is near liquid at ambient temperature, and therefore, is more easily transportable. However, this upgrading may require the construction of facilities, which are expensive and difficult to operate in remote locations.

U.S. Pat. Nos. 6,313,361 and 6,294,076 disclose transporting a mixture of Fischer-Tropsch wax in lighter hydrocarbon liquid. In U.S. Pat. No. 6,294,076, the Fischer-Tropsch wax is granulated into finely divided flakes and then mixed with naphtha in a colloid mill. As disclosed, to provide a pumpable mixture at ambient temperature, the mixture can contain from about 1 to 22 weight % Fischer-Tropsch wax, preferably from about 8 to 10 weight % Fischer-Tropsch wax. However, since the ratio of wax to light hydrocarbons produced from a Fischer-Tropsch process is greater than 25 weight %, this approach cannot transport all of the Fischer-Tropsch wax from the remote location. In U.S. Pat. No. 6,313,361, a slurry is formed from unconsolidated solid wax particles and lighter liquid paraffinic compounds. As disclosed, to provide a stable slurry, the solid wax particles make up about 5 to 30% by volume of the slurry.

Accordingly, efficient methods of transporting waxy hydrocarbons in a pumpable form are desired. It is desired that these methods provide for transportation of the waxy hydrocarbons in a pumpable form without requiring expensive upgrading facilities, without corrosion to the transportation equipment, without requiring the use of heated transportation equipment, and with a safe vapor pressure. Moreover, it is desired that these methods allow for transportation of a product that contains greater than 30 weight % waxy hydrocarbons.

SUMMARY OF THE INVENTION

It has been discovered that paraffinic waxes can be transported efficiently by forming the paraffinic wax into wax particles. The paraffinic wax formed into wax particles can be transported as a transportable product containing the wax particles and a liquid. The stability of transportable product is maintained by ensuring that the amount of wax particles are not too small and the amount of small wax particles is not excessive.

In one embodiment, the present invention relates to a transportable product. The transportable product comprises 90 to 20 weight % of a liquid comprising >50 weight % alcohol and having a true vapor pressure of ≦14.7 psia when measured at 20° C. and 10 to 80 weight % of wax particles. The wax particles comprise ≧75 weight % of wax particles larger than 0.1 mm.

In another embodiment, the present invention relates to a method of transporting wax. The method comprises forming wax particles comprising ≧75 weight % of wax particles larger than 0.1 mm from a paraffinic wax. The wax particles are added to a liquid comprising >50 weight % alcohol and having a true vapor pressure of ≦14.7 psia when measured at 20° C., to form a transportable product comprising 90 to 20 weight % liquid and 10 to 80 weight % wax particles. The transportable product is transported, and the wax particles are separated from the liquid.

In yet another embodiment, the present invention relates to a method of making a transportable Fischer-Tropsch derived product. The method comprises performing a Fischer-Tropsch synthesis to provide a product stream comprising a substantially paraffinic wax product. The substantially paraffinic wax is isolated from the product stream. Wax particles comprising ≧75 weight % of wax particles larger than 0.1 mm are formed from the substantially paraffinic wax. The wax particles are added to a liquid comprising >50 weight % alcohol and having a true vapor pressure of ≦14.7 psia when measured at 20° C., to form a transportable product comprising 90 to 20 weight % liquid and 10 to 80 weight % wax particles.

In a further embodiment, the present invention relates to a method of converting a hydrocarbonaceous asset at a remote site into products that are delivered to a developed site for conversion into salable finished products. The process comprises converting the hydrocarbonaceous asset into syngas. At least a portion of the syngas is converted into a product stream comprising a paraffinic wax by a Fischer-Tropsch process. The wax is formed into wax particles comprising ≧75 weight % of wax particles larger than 0.1 mm. The wax particles are added to a liquid comprising >50 weight % alcohol to form a transportable product comprising 90 to 20 weight % liquid and 10 to 80 weight % of wax particles. The transportable product is maintained at a temperature of ≦65° C. The transportable product is transported to the developed site. The transportable product is unloaded at the developed site. The wax particles are separated from the liquid. At least a portion of the wax particles are converted into salable finished products.

In yet a further embodiment, the present invention relates to a method for transporting a transportable product including at least one first remote site and at least one second developed site comprising receiving at the developed site the transportable product. The transportable product is produced at one or a plurality of remote sites by a method comprising forming wax particles comprising ≧75 weight % of wax particles larger than 0.1 mm from a paraffinic wax. The wax particles are added to a liquid comprising >50 weight % alcohol and having a true vapor pressure of ≦14.7 psia when measured at 20° C., to form a transportable product comprising 90 to 20 weight % liquid and 10 to 80 weight % wax particles. The transportable product is unloaded.

DETAILED DESCRIPTION OF THE INVENTION

Figure 1:
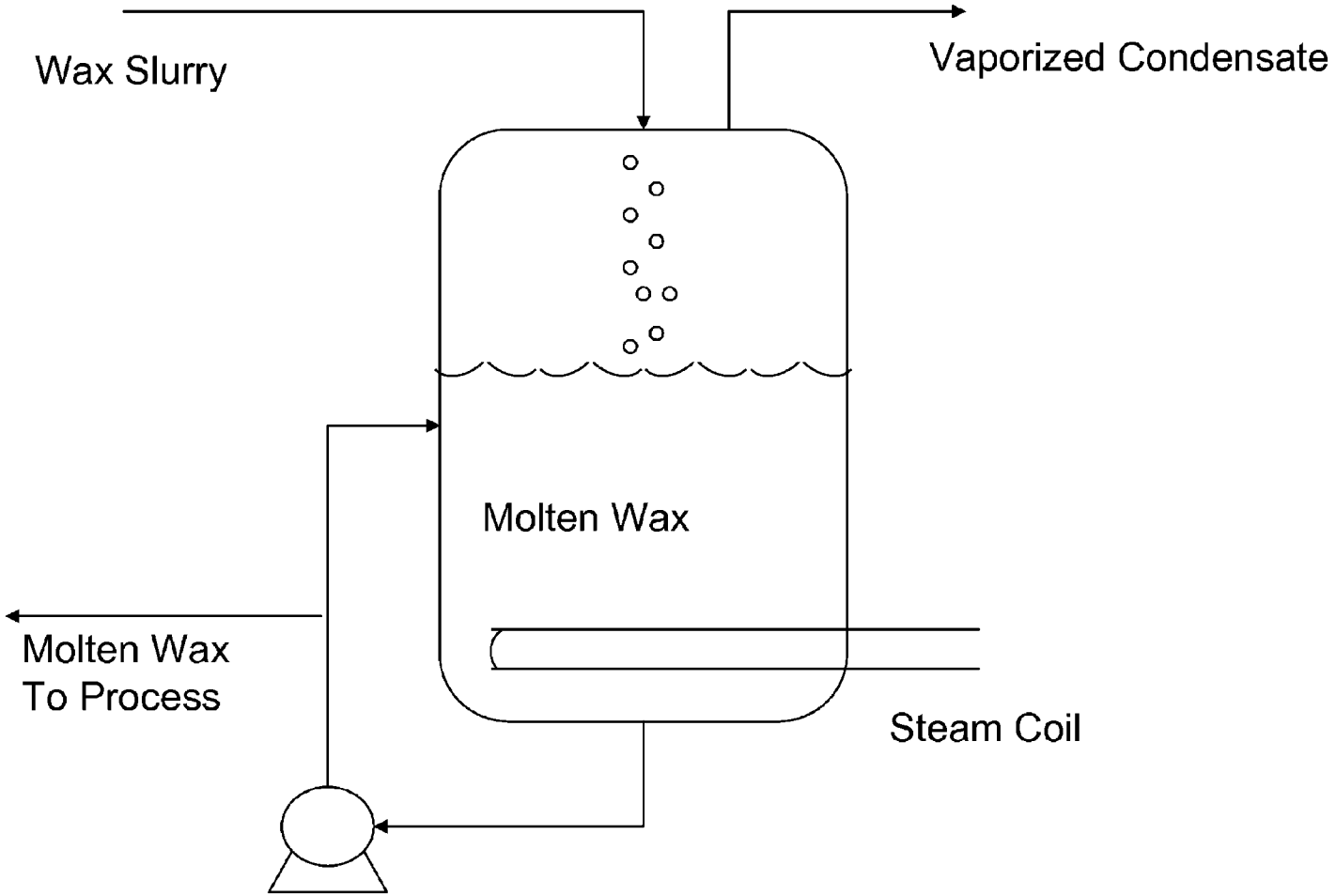
FIG. 1 illustrates a method for separating the wax particles and liquid of a transportable product according to the present invention.

It has been discovered that paraffinic waxes can be efficiently transported as a transportable product comprising a liquid and the paraffinic wax formed into solid wax particles. In the transportable products of the present invention and methods of transporting paraffinic waxes, it is important that the solid wax particles remain unconsolidated solid wax particles in the transportation liquid. Preferably, the transportation liquid is a homogeneous liquid. According to the present invention, the transportable product advantageously comprises 10 to 80 weight % wax particles and 90 to 20 weight % liquid.

The transportable product and methods of transporting of the paraffinic wax according to the present invention are able to accommodate a relatively high weight % of wax particles in the transportable product while avoiding interparticle adhesion and clumping by ensuring that the wax particles are not too small and the amount of small wax particles is not excessive. By ensuring that the wax particles are not too small and the amount of small wax particles is not excessive, interparticle adhesion and clumping is avoided even when the transportable product contains a relatively high weight % of wax particles. Accordingly, the presently claimed invention allows for efficient and economical transportation of relatively large amounts of paraffinic waxes.

The paraffinic wax can be any paraffinic wax, including, for example, Fischer-Tropsch derived wax, petroleum derived wax, slack wax, deoiled slack wax, and mixtures thereof. According to the present invention, preferably, the paraffinic wax is derived from a Fischer-Tropsch process. The wax particles can be in the form of spheres, semi-spheres, flat disks, doughnuts, cylindrical extrudates, multilobe extrudates, and combinations thereof. Preferably, the wax particles are spherical or semi-spherical.

The liquid of the transportable product can be a hydrocarbonaceous liquid, alcohol, water, or a mixture of these liquids. When the liquid is a mixture, preferably it is a homogeneous mixture. When the liquid is a hydrocarbonaceous liquid, the liquid comprises ≧75 weight % of a liquid selected from the group consisting of naphtha, heavy oil, distillate, lubricant base oil, and mixtures thereof. The liquid suitable for use in the transportable product can be a liquid comprising ≧50 weight % water. The liquid suitable for use in the transportable product can also be a liquid comprising >50 weight % alcohol. The limiting size of the wax particles depends to some degree on the liquid used in the transportable product. In addition, depending on the liquid used, the vapor pressure, the flash point, the acid number, and the pH may also need to be controlled to provide an acceptable transportable product.

Preferably, the transportable product according to the present invention has a passing stability rating when measured as described herein at 20° C. for 5 weeks.

DEFINITIONS

The following terms and phrases will be used throughout the specification and will have the following meanings unless otherwise indicated.

"Developed site" refers to a refinery site at which transported products are refined into salable, finished products.

The term "derived from a Fischer-Tropsch process" or "Fischer-Tropsch derived," means that the product, fraction, or feed originates from or is produced at some stage by a Fischer-Tropsch process.

The term "derived from petroleum" or "petroleum derived" means that the product, fraction, or feed originates from a petroleum crude. A slack wax is a petroleum derived wax that can be used in the transportable products and methods of the present invention.

"Slack wax" refers to paraffinic waxes derived from petroleum deoiling or dewaxing operations.

"Higher alcohols" includes alcohols having from 3 to 8 carbon atoms including straight and branched chain alcohols. Examples of higher alcohols include propanol, isopropanol, butanol, t-butanol, pentanol, and the like.

"Hydrocarbonaceous asset" refers to natural gas, methane, coal, petroleum, tar sands, oils shale, shale oil, and derivatives and mixtures thereof.

"Hydrocarbonaceous material" refers to a pure compound or mixtures of compounds containing hydrogen and carbon and optionally sulfur, nitrogen, oxygen, and other elements. Examples include crudes, synthetic crudes, petroleum products such as gasoline, jet fuel, diesel fuel, lubricant base oil, and alcohols such as methanol and ethanol.

"Hydrocarbonaceous liquid" refers to a liquid that comprises ≧75 weight % of a liquid selected from the group consisting of naphtha, heavy oil, distillate, lubricant base oil, and mixtures thereof.

"Essentially alcohol" refers to a liquid comprising ≧95 weight % alcohol.

"Essentially water" refers to a liquid comprising ≧95 weight % water.

Marine Tanker refers to a ship used for transporting hydrocarbons, typically, but not limited to, crude oil and refined products.

"Remote site" refers to a site which contains or is near a hydrocarbon asset and more than 100 km from a developed site. According to the present invention, the transportable product, comprising liquid and wax particles, is transported from one or more remote sites to a developed site.

Screens and Mesh Size: In this application the screens and the mesh size equivalent are taken from ASTM E11. For determining sizes larger than 40 mesh, the material is placed on dry stainless steel screens and shaken by hand both vertically and horizontally at about 1 vibration per second over a four inch distance for at least five minutes, and if necessary for a sufficient time so that amount of material on the screens does not change visually. To insure that the sieving is complete and an accurate measurement of the fines is obtained, the particles are examined under a microscope using a calibrated eye piece of the microscope. For sizes smaller than 40 mesh other suitable techniques (preferably light scattering) are used to determine the percentage smaller than a given size, and the amount of material passing through the equivalent mesh size is calculated using the sizes in ASTM E11.

"Smaller" refers to particles that will fall through a sieve cloth with size designated according to ASTM E11. For example, particles smaller than 2.4 mm (8 mesh) will fall through a sieve cloth with an average opening of 2.4 mm, the average opening being the distance between parallel wires measured at the center of the opening, in the horizontal and vertical directions, measured separately. According to ASTM E11, a sieve cloth with an average opening of 2.4 mm may alternatively be designated 8 mesh.

Conversely, "larger" refers to particles that will not fall through a sieve cloth with size designated according to ASTM E11. For example, particles larger than 2.4 mm (8 mesh) will not fall through a sieve cloth with an average opening of 2.4 mm, the average opening being the distance between parallel wires measured at the center of the opening, in the horizontal and vertical directions, measured separately. According to ASTM E11, a sieve cloth with an average opening of 2.4 mm may alternatively be designated 8 mesh.

"Salable products" refers to refined products from crude or synthetic crude meeting specifications for sale in regional markets. Examples include gasoline, jet fuel, diesel fuel, lubricant base oil, and blend components thereof.

Syngas or synthesis gas refers to a gaseous mixture containing carbon monoxide (CO) and hydrogen and optionally other components such as water and carbon dioxide. Sulfur and nitrogen and other heteroatom impurities are not desirable since they can poison the downstream Fischer-Tropsch process. These impurities can be removed by conventional techniques.

Reid Vapor Pressure Measurement: Various ASTM methods have been developed over the years to measure Reid Vapor Pressure including D323, D4953, D5190, D5191, D6377 and D6378. D323 was the original method; however, it is rarely used today. For purposes of this application, the Reid Vapor Pressure should be measured by D5191 provided that the material has a D2887 95% point below 700° F. and is fluid at 20° C.; otherwise D323 is used.

Total Vapor Pressure Measurement: For mixtures containing hydrocarbons, the Total Vapor Pressure should be calculated using the Reid Vapor Pressure and the nomograph provided in FIG. 4 of API Publication 2517, $2^{nd}$ Edition, February 1980, "Evaporative Loss from External Floating-Roof Tanks." The stock temperature in this nomograph is taken as 20° C. (68° F.). For liquids which are almost exclusively a single compound, literature references can be used for the total vapor pressure. For water, the true vapor pressure was determined from Steam Tables. At 20° C. (68° F.) the pressure of saturated steam is 0.33889 psia from Handbook of Chemistry and Physics, $49^{th}$ Edition, page E-17. The true vapor pressure of methanol is in the Handbook of Chemistry and Physics, $49^{th}$ Edition, page D-121. At 21.2° C. the true vapor pressure of methanol is 100 mm Hg (1.93 psia), and at 20° C. it is interpolated using the Clausius Clapeyron equation to be 95.5 mm Hg (1.85 psia). The total vapor pressure of mixtures of water and alcohols can be determined by appropriate experimental methods well known to one of skill in the art.

Transportation temperature: For marine vessels, railroad cars, tankers, etc. operating without heat, the transportation temperature is 20° C., which is representative of a typical environment.

The present invention relates to a transportable product comprising a liquid and wax particles and methods of transporting wax utilizing this transportable product. According to the present invention, the transportable product advantageously comprises 90 to 20 weight % liquid and 10 to 80 weight % wax particles, preferably 25 to 80 weight % wax particles, more preferably 28 to 80 weight % wax particles, and even more preferably 30 to 80 weight % wax particles. The transportable product according to the present invention has a passing stability rating when measured as described herein at 20° C. for 5 weeks.

Liquid

The liquid of the transportable product can be a hydrocarbonaceous liquid, alcohol, water, or a mixture of these liquids. When the liquid is a mixture, preferably it is a homogeneous mixture. In embodiments in which the liquid is a hydrocarbonaceous liquid, the liquid comprises ≧75 weight % of a liquid selected from the group consisting of naphtha, heavy oil, distillate, lubricant base oil, and mixtures thereof, and in certain of these embodiments, preferably, the hydrocarbonaceous liquid is naphtha. When the hydrocarbonaceous liquid is a naphtha, the naphtha can be selected from the group consisting of petroleum derived naphtha, Fischer-Tropsch derived naphtha, and mixtures thereof.

In other embodiments, the liquid comprises >50 weight % alcohol, and in certain of these embodiments, the liquid can be essentially alcohol (i.e., ≧95 weight % alcohol). When the liquid comprises an alcohol, the alcohol can be methanol, ethanol, higher alcohols, and mixtures thereof. When an alcohol is used in the liquid of the transportable product, preferably the alcohol is methanol and the liquid can be ≧90 weight % methanol or essentially methanol (i.e., ≧95 weight % methanol). In alternative embodiments, the liquid comprises ≧50 weight % water, and in certain of these embodiments, the liquid can be essentially water (i.e., ≧95 weight % water).

As stated above, the liquid may be a mixture of these different liquids, preferably a homogeneous mixture. Accordingly, when the liquid is a hydrocarbonaceous liquid, the hydrocarbonaceous liquid may further comprise alcohol, water, or mixtures thereof. When the liquid is a mixture comprising a hydrocarbonaceous liquid, it preferably further comprises alcohol. When the liquid comprises >50 weight % alcohol, the liquid may further comprise water, hydrocarbonaceous liquid, or mixtures thereof. Preferably, when the liquid comprises >50 weight % alcohol, the liquid further comprises water, and even more preferably, the liquid is a homogeneous mixture of alcohol and water. In certain of these embodiments, the liquid comprises ≧90 weight % alcohol and ≦10 weight % water. When the liquid comprises ≧50 weight % water, the liquid may further comprise hydrocarbonaceous liquid, alcohol, or mixtures thereof. In certain of these embodiments, when the liquid comprises ≧50 weight % water, the liquid further comprises alcohol, and even more preferably, the liquid is a homogeneous mixture of alcohol and water. In certain of these embodiments, the liquid comprises ≧90 weight % water and ≦10 weight % alcohol. Preferred homogeneous mixtures include methanol-water and methanol-naphtha.

The limiting size of the wax particles depends to some degree on the liquid used in the transportable product. In addition, depending on the liquid used, the vapor pressure, the flash point, the acid number, and the pH may also need to be controlled to provide an acceptable transportable product.

Factors that are important based on the liquid are summarized in Table I below. In Table I, where appropriate, preferred values are listed as the second value, more preferred values are listed as the third value, and even more preferred values are listed as the fourth value.

TABLE I

| | Hydrocarbonaceous liquid | Liquid comprises ≧50 wt % Water | Liquid comprises >50 wt % Alcohol (Methanol) |
|---|---|---|---|
| Liquid vapor pressure, psia | ≦14.7 | ≦14.7 | ≦14.7 |
| Wax content | 10-80 wt % | 10-80 wt % | 10-80 wt % |
| Stability | ≦5 at 20° C.<br>≦5 at 30° C. | ≦5 at 20° C.<br>≦5 at 30° C. | ≦5 at 20° C.<br>≦5 at 30° C. |
| Surfactant | None - but optionally added | None - but optionally added | None - but optionally added |
| Acidity | ≦1.5 mg KOH/g<br>≦0.5 mg KOH/g | pH > 5 | ≦1.5 mg KOH/g<br>≦0.5 mg KOH/g |

TABLE I-continued

| | Hydrocarbonaceous liquid | Liquid comprises ≧50 wt % Water | Liquid comprises >50 wt % Alcohol (Methanol) |
|---|---|---|---|
| Flash point, ° C. | ≧60 | ≧60 | — |
| Molecular Weight | <500<br><300<br>100-200 | — | — |
| Wax | ≦10% through 8 mesh | ≦25% through 140 mesh | |
| Particle Size | ≦10% through 7 mesh | ≦10% through 140 mesh<br>≦10% through 8 mesh<br>≦10% through 7 mesh | |

A concern when transporting the transportable product according to the present invention is vapor pressure. International maritime regulations limit the maximum Reid Vapor Pressure of crude carried aboard conventional tankers to "below atmospheric pressure" (i.e., less than 14.7 psia). These same regulations limit the closed cup flash point to 60° C. or higher (Safety of Life at Sea (SOLAS) Chapter 22, Regulation 55.1). Accordingly, a practical operational limit is a flash point of ≧60° C. A practical operational limit is a True Vapor Pressure (not Reid Vapor Pressure) of about 9-10 psia for conventional tankers. A True Vapor Pressure higher than approximately 10 or 11 psia during pumping may make it difficult to fully discharge the tanker's cargo tanks, although the actual pumping performance will depend on the particular ship. Receiving shoreside terminals commonly have a maximum True Vapor Pressure limit of 11 psia, based on the maximum capability of floating roof storage tanks. Given that the transportable products according to the present invention are designed to be shipped at near ambient temperatures, the True Vapor Pressure of the liquid should be less than or equal to 14.7 psia when measured at 20° C., preferably less than or equal to 11 psia when measured at 20° C., and more preferably less than or equal to 9 psia when measured at 20° C.

Another concern when transporting is corrosion. Corrosion can present significant problems with the transportation vessel. The light hydrocarbonaceous products and water from a Fischer-Tropsch process can contain significant quantities of acids, thus making them highly corrosive. Corrosion on ships has been linked to several major disasters. One method to prevent corrosion is to paint the metal surfaces of ships or coat them with a corrosion-resistant substance. However, it is very difficult to maintain the coating of all surfaces, and any uncoated surface can lead to problems. The acids present in Fischer-Tropsch products can be corrosive, especially to ferrous metals (irons and steels). Ferrous corrosion can present significant problems with ships, pumps, tanks, storage vessels, railroad cars, trucks, and shipping systems, such as pipelines.

In refining conventional petroleum, it is standard that crude oils should have total acid numbers less than 0.5 mg KOH/g in order to avoid corrosion problem. It is further stated that distillate fractions have acid numbers less than 1.5 mg KOH/g. See, "Materials Selection for Petroleum Refineries and Gathering Facilities", Richard A. White, NACE International, 1998 Houston Tex. pages 6-9. Appropriate standards for ferrous corrosion are given in the Colonial Pipeline Company's Section 3 Quality Assurance, section 3.2.2 (Page 3B—3 Feb. 2003) which requires that "all products shipped on Colonial Pipeline, with the exception of all grades of Aviation Kerosene, are required to meet a minimum level of corrosion protection. The concentration of inhibitor dosage will be controlled to meet a minimum rating of B+ (less than 5% of test surface rusted) as determined by NACE Standard TM0172-2001, Test Method-Antirust Properties Petroleum Products Pipeline Cargoes."

Therefore, according to the present invention, it is important to control the acidity of the transportation liquid. As such, when the liquid is a hydrocarbonaceous liquid or comprises >50 weight % alcohol, the liquid should have an acid number of less than 1.5 mg KOH/g, preferably less than 0.5 mg KOH/g. When the liquid comprises ≧50 weight % water, the liquid should have a pH>5, preferably >6.5.

When the liquid is a hydrocarbonaceous liquid, the liquid should have a relatively low molecular weight. As the molecular weight of the hydrocarbonaceous liquid increases, the wax particles have a greater tendency to dissolve in the liquid. Accordingly, it is important that the hydrocarbonaceous liquid have a molecular weight that is not too high. As such, preferably the molecular weight of the hydrocarbonaceous liquid is less than 500 g/mol, more preferably less than 300 g/mol, and even more preferably 100-200 g/mol.

Unlike emulsions, surfactants are not required in the liquids for the transportable products according to the present invention and thus may optionally be added. Although not required, surfactants may be useful in forming homogeneous liquids when the liquid is a mixture.

Wax Particles

The paraffinic wax to be transported as wax particles according to the present invention can be any paraffinic wax. Preferably, the paraffinic wax suitable for use in the present invention is highly paraffinic and as such, contains a high amount of n-paraffins, preferably greater than 40 weight %, more preferably greater than 50 weight %, and even more preferably greater than 75 weight %. Examples of suitable paraffinic waxes include, but are not limited to, Fischer-Tropsch derived wax, petroleum derived wax such as deoiled petroleum derived waxes, slack wax and deoiled slack waxes, refined foots oils, waxy lubricant raffinates, n-paraffin waxes, NAO waxes, waxes produced in chemical plant processes, microcrystalline waxes and mixtures thereof. The paraffinic waxes of the present invention are solid at room temperature and preferably, have a pour point of greater than 60° C.

It has been discovered that paraffinic waxes can be efficiently transported as a transportable product comprising a liquid and the paraffinic wax in the form of solid wax particles. In the transportable products of the present invention and methods of transporting paraffinic waxes, it is important that the solid wax particles remain unconsolidated solid wax particles in the transportation liquid. The transportable product and methods of transporting of the paraffinic wax according to the present invention are able to accommodate a relatively high weight % of wax particles in the transportable product while avoiding interparticle adhesion and clumping by ensuring that the wax particles are not too small and the amount of small wax particles is not excessive. By ensuring that the wax particles are not too small and the amount of small wax particles is not excessive, interparticle adhesion and clumping is avoided even when the transportable product contains a relatively high weight % of wax particles. According to the present invention, the transportable product advantageously comprises 90 to 20 weight % liquid and 10 to 80 weight % wax particles, preferably 25 to 80 weight % wax particles, more preferably 28 to 80 weight % wax particles, and even more preferably 30 to 80 weight % wax particles.

The wax particles can be in the form of spheres, semi-spheres, flat disks, doughnuts, cylindrical extrudates, multi-lobe extrudates, and mixtures thereof. Preferably, the wax particles are spherical or semi-spherical. It is preferred that the finished particle is in a shape that offers the least resistance to movement and does not contain excessively small particles. Since interparticle adhesion is facilitated by contact between the surfaces of the particles, clumping of particles is minimized when the surface to volume ratio is minimized. Minimizing the surface to volume ratio of the particle also minimizes the amount of wax that dissolves into the liquid per unit time. Thus, the most desired shape is a sphere or semi-spherical solid, preferably a sphere or semi-sphere where the ratio of the major to minor axis does not exceed 3, and more preferably, does not exceed 2. Other possible, but less desirable, shapes include particles in the form of flat disks, doughnuts, or with pointy appendages.

Given that the volume fraction of space occupied by uniform spheres in hexagonal arrangement (the closest possible arrangement) is 0.7405, the maximum weight % of wax in the transportable product will be approximately 80 weight %. The higher density of wax will increase the percentage slightly beyond the volume maximum, as will the use of slightly non-spherical wax particles and particles with varying sizes. Computer simulation of random packing of equal-sized spheres gives a volume fraction of space filled of 0.64. Thus, a more practical upper limit for the wax content of uniform particles may be about 70 weight %.

It is acceptable to produce a range of sizes provided that the vast majority of the particles are larger than 0.1 mm. Preferably, the vast majority of the particles are larger than 1 mm, more preferably larger than 2 mm, and even more preferably larger than 4 mm. However, to facilitate pumping, the particles must not be too large, and preferably are smaller than 50 mm in size.

The minimum size of the wax particles and the weight percentage of small particles that can be used while avoiding interparticle adhesion and clumping depends to some degree on the liquid used to form the transportable product, the concentration of the wax, and temperature of transport.

When the transportable liquid is a hydrocarbonaceous liquid, the wax particles comprise ≧90 weight % of wax particles larger than 2.4 mm, preferably ≧90 weight % of wax particles larger than 2.8 mm. When the transportable liquid comprises >50 weight % alcohol, the wax particles comprise ≧75 weight % of wax particles larger than 0.1 mm, preferably ≧90 weight % of wax particles larger than 0.1 mm, and even more preferably ≧90 weight % of wax particles larger than 2.8 mm. When the transportable liquid comprises ≧50 weight % water, the wax particles comprise ≧75 weight % of wax particles larger than 0.1 mm, preferably ≧90 weight % of wax particles larger than 0.1 mm, and even more preferably ≧90 weight % of wax particles larger than 2.8 mm.

Transportable Product

The transportable product according to the present invention advantageously comprises 10 to 80 weight % wax particles and 90 to 20 weight % liquid. Preferably, the transportable product comprises 25 to 80 weight % wax particles, more preferably 28 to 80 weight % wax particles, and even more preferably 30 to 80 weight % wax particles.

Interparticle adhesion and clumping is avoided by ensuring that the amount of small wax particles is not excessive, the limiting size depending on the liquid. Small wax particles may slowly dissolve into the liquid; thus, the wax particles must not be too small and the amount of small wax particles must not be excessive. In addition, in certain liquids the particles are more likely to dissolve; therefore, the limiting size for the small particles may be relatively larger for these liquids. When hydrocarbonaceous liquids are used, the wax particles have a greater tendency to dissolve. Therefore, the wax particles must not be too small and need to be relatively larger than if the liquid comprises >50 weight % alcohol or ≧50 weight % water. As such, when the transportable liquid is a hydrocarbonaceous liquid, for example naphtha, the wax particles comprise ≧90 weight % of wax particles larger than 2.4 mm (8 mesh), preferably ≧90 weight % of wax particles larger than 2.8 mm (7 mesh). When water or alcohol is used as the transportable liquid, smaller size particles can be used without unacceptable interparticle adhesion and clumping. As such, if the transportable liquid comprises >50 weight % alcohol or ≧50 weight % water, the wax particles may comprise ≧75 weight % of wax particles larger than 0.1 mm (140 mesh), preferably ≧90 weight % of wax particles larger than 0.1 mm (140 mesh), and even more preferably ≧90 weight % of wax particles larger than 2.8 mm.

By increasing the size of the wax particles, the reduction of surface area per unit mass reduces the amount of wax that slowly dissolves into the transportation liquid to the point that the transportable product can be stored and shipped over a 5 week period. However, to facilitate pumping, the wax particles should be smaller than 50 mm. While the use of surfactants to form emulsions is not required, surfactants can be added.

An excessive amount of small wax particles, or fines, will result in an unstable transportable product. Thus, if wax particle formation produces an excessive amount of fines, the fines should be removed. When wax is cooled with dry ice, it may fragment into fines. While fines can be removed by conventional sieving operations done on either the transportable product or the wax particles, it is preferable to minimize the formation of fines so that a stable transportable product can be prepared without the need for a step to remove fines. Recovered fines can be melted and processed again.

Dissolution of the wax particles into the liquid is a function of the temperature of the transportable product and of the liquid. When the liquid is a hydrocarbonaceous liquid, for example naphtha, it is important that the transportable product not exceed 50° C., even for short periods of time. Preferably for hydrocarbonaceous liquids, the transportable product does not exceed 40° C., and more preferably the transportable product does not exceed 30° C. for a long period of time. Most preferably when the liquid is a hydrocarbonaceous liquid, the transportable product is maintained between about 10-30° C.

Although not as likely to dissolve in alcohol, water, or mixtures thereof, the wax particles can dissolve into heated alcohol, water, or alcohol/water mixtures. Accordingly, when the liquid comprises >50 weight % alcohol, ≧50 weight % water, and an alcohol/water mixture, it is important that the transportable product not exceed 65° C. and preferably does not exceed 50° C.

Due to increased efficiencies, preferably, the wax particles and the liquid of the transportable product originate from a common site and more preferably from a common source.

A natural gas or coal asset for producing synthesis gas is often found at a remote site and is often also located at the same remote site as an oil field. Accordingly, preferably, both the paraffinic wax to be transported as wax particles and the liquid to be used in the transportable product originate in some form from the natural gas or coal asset and/or the oil field.

By way of example, in one embodiment if the wax particles are derived from a Fischer-Tropsch process, preferably, the liquid of the transportable product is also derived from a Fischer-Tropsch process. Hydrocarbonaceous liquids, water, and alcohol can be derived from a Fischer-Tropsch process. In addition to increased efficiencies, using a liquid also derived from a Fischer-Tropsch process prevents any introduction of unwanted contaminants, such as nitrogen containing compounds and sulfur containing compounds, into Fischer-Tropsch derived wax particles.

In an additional embodiment, the natural gas or coal asset can be used to provide synthesis gas for a Fischer-Tropsch process to provide wax particles, and the synthesis gas generated from the natural gas or coal asset can also be used in a methanol synthesis process to provide methanol. The methanol can be used as the liquid or a portion of the liquid of the transportable product.

If the wax particles are derived from petroleum, preferably the liquid of the transportable product can also be derived from the oil field providing the petroleum derived wax. As such, the liquid can be a petroleum derived naphtha, a petroleum derived heavy oil, petroleum derived distillate, petroleum derived lubricant base oil, and mixtures thereof.

As a natural gas or coal asset for producing synthesis gas and an oil field are often found at the same remote site, the wax particles may be derived from one or both of these sources and the liquid of the transportable product may also be derived from the same source as the wax particles, the other source, or a combination of the sources.

If the transportable liquid is a hydrocarbonaceous liquid, ≧75 weight % of the liquid is selected from the group consisting of naphtha, heavy oil, distillate, lubricant base oil, and mixtures thereof. Preferably, the hydrocarbonaceous liquid has a sulfur content of ≦100 ppmw, preferably ≦10 ppmw. Preferably when the transportable liquid is a hydrocarbonaceous liquid, the liquid is naphtha. The naphtha can be selected from the group consisting of petroleum derived naphtha, Fischer-Tropsch naphtha, and mixtures thereof. Due to increased efficiencies, if the wax particles are derived from a Fischer-Tropsch process, preferably the naphtha is a Fischer-Tropsch derived naphtha, and if the wax particles are derived from petroleum, for example slack wax, preferably, the naphtha is a petroleum derived naphtha. It is also advantageous to utilize Fischer-Tropsch derived wax particles with a Fischer-Tropsch derived liquid because Fischer-Tropsch products have extremely low amounts of contaminants such as sulfur containing compounds and nitrogen containing compounds.

Fischer-Tropsch Synthesis Process

Preferably, the wax particles according to the present invention are derived from a Fischer-Tropsch process. In an even more preferred embodiment, at least a portion of the transportation liquid is also derived from a Fischer-Tropsch process.

In Fischer-Tropsch chemistry, syngas is converted to liquid hydrocarbons by contact with a Fischer-Tropsch catalyst under reactive conditions. Typically, methane and optionally heavier hydrocarbons (ethane and heavier) can be sent through a conventional syngas generator to provide synthesis gas. Generally, synthesis gas contains hydrogen and carbon monoxide, and may include minor amounts of carbon dioxide and/or water. The presence of sulfur, nitrogen, halogen, selenium, phosphorus and arsenic contaminants in the syngas is undesirable. For this reason and depending on the quality of the syngas, it is preferred to remove sulfur and other contaminants from the feed before performing the Fischer-Tropsch chemistry. Means for removing these contaminants are well known to those of skill in the art. For example, ZnO guardbeds are preferred for removing sulfur impurities. Means for removing other contaminants are well known to those of skill in the art. It also may be desirable to purify the syngas prior to the Fischer-Tropsch reactor to remove carbon dioxide produced during the syngas reaction and any additional sulfur compounds not already removed. This can be accomplished, for example, by contacting the syngas with a mildly alkaline solution (e.g., aqueous potassium carbonate) in a packed column.

In the Fischer-Tropsch process, contacting a synthesis gas comprising a mixture of $H_2$ and CO with a Fischer-Tropsch catalyst under suitable temperature and pressure reactive conditions forms liquid and gaseous hydrocarbons. The Fischer-Tropsch reaction is typically conducted at temperatures of about 300-700° F. (149-371° C.), preferably about 400-550° F. (204-228° C.); pressures of about 10-600 psia, (0.7-41 bars), preferably about 30-300 psia, (2-21 bars); and catalyst space velocities of about 100-10,000 cc/g/hr, preferably about 300-3,000 cc/g/hr. Examples of conditions for performing Fischer-Tropsch type reactions are well known to those of skill in the art.

The products of the Fischer-Tropsch synthesis process may range from $C_1$ to $C_{200+}$ with a majority in the $C_5$ to $C_{100+}$ range. The reaction can be conducted in a variety of reactor types, such as fixed bed reactors containing one or more catalyst beds, slurry reactors, fluidized bed reactors, or a combination of different type reactors. Such reaction processes and reactors are well known and documented in the literature.

The slurry Fischer-Tropsch process, which is preferred in the practice of the invention, utilizes superior heat (and mass) transfer characteristics for the strongly exothermic synthesis reaction and is able to produce relatively high molecular weight, paraffinic hydrocarbons when using a cobalt catalyst. In the slurry process, a syngas comprising a mixture of hydrogen and carbon monoxide is bubbled up as a third phase through a slurry which comprises a particulate Fischer-Tropsch type hydrocarbon synthesis catalyst dispersed and suspended in a slurry liquid comprising hydrocarbon products of the synthesis reaction which are liquid under the reaction conditions. The mole ratio of the hydrogen to the carbon monoxide may broadly range from about 0.5 to about 4, but is more typically within the range of from about 0.7 to about 2.75 and preferably from about 0.7 to about 2.5. A particularly preferred Fischer-Tropsch process is taught in EP 0609079, also completely incorporated herein by reference for all purposes.

In general, Fischer-Tropsch catalysts contain a Group VIII transition metal on a metal oxide support. The catalysts may also contain a noble metal promoter(s) and/or crystalline molecular sieves. Suitable Fischer-Tropsch catalysts comprise one or more of Fe, Ni, Co, Ru and Re, with cobalt being preferred. A preferred Fischer-Tropsch catalyst comprises effective amounts of cobalt and one or more of Re, Ru, Pt, Fe, Ni, Th, Zr, Hf, U, Mg and La on a suitable inorganic support material, preferably one which comprises one or more refractory metal oxides. In general, the amount of cobalt present in the catalyst is between about 1 and about 50 weight % of the total catalyst composition. The catalysts can also contain basic oxide promoters such as $ThO_2$, $La_2O_3$, MgO, and $TiO_2$, promoters such as $ZrO_2$, noble metals (Pt, Pd, Ru, Rh, Os, Ir), coinage metals (Cu, Ag, Au), and other transition metals such as Fe, Mn, Ni, and Re. Suitable support materials include alumina, silica, magnesia and titania or mixtures thereof. Preferred supports for cobalt containing catalysts comprise titania. Useful catalysts and their preparation are known and illustrated in U.S. Pat. No. 4,568,663, which is intended to be illustrative but non-limiting relative to catalyst selection.

Certain catalysts are known to provide chain growth probabilities that are relatively low to moderate, and the reaction products include a relatively high proportion of low molecular ($C_{2-8}$) weight olefins and a relatively low proportion of high molecular weight ($C_{30+}$) waxes. Certain other catalysts are known to provide relatively high chain growth probabilities, and the reaction products include a relatively low proportion of low molecular ($C_{2-8}$) weight olefins and a relatively high proportion of high molecular weight ($C_{30+}$) waxes. Such catalysts are well known to those of skill in the art and can be readily obtained and/or prepared.

The product from a Fischer-Tropsch process contains predominantly paraffins. The products from Fischer-Tropsch reactions generally include a light reaction product and a waxy reaction product. The light reaction product (i.e., the condensate fraction) includes hydrocarbons boiling below about 700° F. (e.g. tail gases through middle distillate fuels), largely in the $C_5$-$C_{20}$ range, with decreasing amounts up to about $C_{30}$. The waxy reaction product (i.e., the wax fraction) includes hydrocarbons boiling above about 600° F. (e.g., vacuum gas oil through heavy paraffins), largely in the $C_{20+}$ range, with decreasing amounts down to $C_{10}$.

Both the light reaction product and the waxy product are substantially paraffinic. The waxy product generally comprises greater than 70 weight % normal paraffins, and often greater than 80 weight % normal paraffins. The light reaction product comprises paraffinic products with a significant proportion of alcohols and olefins. In some cases, the light reaction product may comprise as much as 50 weight %, and even higher, alcohols and olefins. It is the waxy reaction product (i.e., the wax fraction) that is transported according to the present invention as wax particles, and it is the light reaction product that can be used to provide the liquid of the transportable product.

The light reaction product can be used to provide a hydrocarbonaceous liquid, alcohol, or mixtures thereof. In addition, water suitable for use as the liquid in the transportable product can be derived from the Fischer-Tropsch process. Water is produced during the Fischer-Tropsch process as a significant by-product and cooling water is used in the Fischer-Tropsch process, both of which can be sources for water suitable for use in the transportable product. Preferably, the light reaction product is used to provide a naphtha to be utilized as the liquid of the transportable product according to the present invention. To provide a liquid suitable for use in the transportable product, it may be necessary to upgrade the Fischer-Tropsch light product by processes well-known to those of skill in the art. These processes for providing an acceptable liquid suitable for use in the transportable product include dehydration, decarboxylation, adsorption, hydrotreating, hydrocracking, and combinations thereof.

The hydrocarbonaceous liquid can be derived from the light products of the Fischer-Tropsch process. By way of example, while naphtha can be purchased on the open market and can consist of aromatic, naphthenic, paraffinic compounds, and mixtures thereof, it is preferable to use a light hydrocarbon Fischer-Tropsch product. From an economic standpoint, it is preferable to ship the wax particles in Fischer-Tropsch light products, such as condensates and naphthas, rather than water, methanol, or mixtures thereof.

However, light hydrocarbon Fischer-Tropsch products frequently contain oxygenates in the form of alcohols and acids, which can result in corrosion. Thus, it is important that the light hydrocarbon Fischer-Tropsch product be treated to reduce its acid number to less than 1.5 mg KOH/g, and more preferably less than 0.5 mg KOH/g. Methods for reducing acid number include, but are not limited to, hydrotreating, hydrocracking, adsorption on zeolites, and adsorption on clays. Further, oxygenates can be removed by dehydration and decarboxylation, thereby reducing the acid number of the Fischer-Tropsch light product to less than 1.5 mg KOH/g, preferably less than 0.5 mg KOH/g.

The water derived from a Fischer-Tropsch process also can be acidic. Accordingly, for the water derived from a Fischer-Tropsch process, it is important to treat the water to increase its pH to greater than 5 and preferably greater than 6.5.

It is also possible to mix naphthas derived from petroleum with the Fischer-Tropsch naphthas to form blended naphthas that have an acid number of less than 1.5 mg KOH/g, preferably less than 0.5 mg KOH/g. It is further possible to hydrotreat or hydrocrack such blended naphthas to reduce the acid number of the blended naphthas to than 1.5 mg KOH/g and preferably less than 0.5 mg KOH/g. Preferably, the hydrocarbonaceous liquid has a sulfur content of ≦100 ppmw, preferably ≦10 ppmw. Fischer-Tropsch light products have low sulfur contents. If the hydrocarbonaceous liquids are blends of Fischer-Tropsch liquids and petroleum derived liquids, hydrotreating or hydrocracking can also be used to reduce the sulfur content of the blended liquids.

If the liquid of the transportable product is an alcohol, alcohols can be derived from the products of the Fischer-Tropsch process. Alcohols can be derived from the products of the Fischer-Tropsch process by techniques well known to those of skill in the art. Furthermore, the liquid of the transportable product may be a mixture of the above liquids, all of which are derived from the Fischer-Tropsch process. Using one or more liquids derived from the Fischer-Tropsch process to transport the wax also produced from the Fischer-Tropsch process, provides great efficiencies. A liquid from an outside source does not need to be brought to the remote location to transport the wax and more of the Fischer-Tropsch products are transported to a developed location to provide salable products in a single shipment. In addition, both the wax and liquid have low amounts of contaminants such as nitrogen containing compounds and sulfur containing compounds.

When water is the liquid used to form the transportable product, it must not be highly corrosive and thus, should have a pH of greater than 5, preferably greater than 6.5. The liquid may also be water from the Fischer-Tropsch process. In the Fischer-Tropsch process, the water may be produced as a by-product of the Fischer-Tropsch process, produced in related gasification and hydroprocessing operations of a Gas-to-Liquids (GTL) facility. In addition, the water can come from the cooling water needed for the Fischer-Tropsch process. Accordingly, if the liquid of the transportable product is water, the water can be derived from the water by-product, from the cooling water, or a mixture thereof. Water derived from the Fischer-Tropsch products is highly acidic and contains alcohols, which can result in corrosion. Thus, it is important to treat the water to increase its pH to greater than 5 and preferably greater than 6.5. The water can be treated to increase its pH to an acceptable level by numerous technologies well known to those of skill in the art, and as described in PCT applications WO 03/106354 A1, WO 03/106346 A1, WO 03/106353 A1, WO 03/106351 A1, and WO 03/106349 A1, and references cited therein.

Moreover, a natural gas or coal asset for producing synthesis gas is often found located at the same site as an oil field. In these instances, the wax particles may be derived from a process for converting synthesis gas into higher hydrocarbon products (i.e., a Fischer-Tropsch process), from the oil field (i.e., slack wax), or mixtures thereof. Using a liquid derived from the process for converting synthesis gas into higher hydrocarbon products, a liquid derived from the oil field, or mixtures thereof with these wax particles can provide similar efficiencies.

Alcohols, such as methanol, to be used in the transportable product can be purchased on the open market or produced from syngas by processes well known to those of skill in the art. When methanol is produced from syngas by a methanol synthesis process, it is preferred to use a portion of that syngas in a Fischer-Tropsch process to products including waxes as well. However, methanol cannot be shipped in conventional crude tankers because of its low flash point and thus, must be shipped in large chemical-grade tankers equipped for low flash materials. Water may be added to methanol in order to decrease the vapor pressure. As water is added to methanol, the density of the solution will increase. If there is a high content of water in the methanol-water solution, allowances for floating wax particles must be made, as the density of the methanol-water solution may be greater than the density of the wax particles. Therefore, methanol-water solutions preferably contain greater than 90% methanol.

When naphtha is the transportable liquid, alcohols can be blended into the naphtha and the blend can be shipped in conventional crude tankers, provided that the vapor pressure and flash point specifications are met.

Stability of the Transportable Product

Among the key aspects of the transportable product according to the present invention is the stability that it exhibits despite the relatively high weight % of wax. For wax particles 3.4 mm (6 mesh) and smaller, the test for the stability of the transportable product is performed as follows:

1. Mixing wax particles, in an amount equal to that which will be transported, between 10 and 80 weight %, 50 weight % being a typical concentration, in the transportation liquid in an 8 dram Pyrex vial obtained from Fisher Scientific (25 mm OD×95 mm height, Catalog No 03-338).
2. Storing the transportable product for 5 weeks at 20° C., which reflects the typical temperature during ocean voyages.
3. Rating the stability of the transportable product, according to Table II below, by inverting the vial and observing whether the wax particles drop to the bottom of the vial.

Satisfactory (passing) stability is obtained when the wax particles drop immediately to the bottom or when the majority of the wax particles drop to the bottom with less than five light taps where the light taps are generated by dropping the inverted vial from a height of 3 cm.

TABLE II

| Rating | Description |
|---|---|
| 1 | All the wax particles drop immediately to the bottom as free-flowing individual wax particles. |
| 2 | Most of the wax particles drop to the bottom as free-flowing wax particles after 1 tap. |
| 3 | Most of the wax particles drop immediately to the bottom as a partially dispersed clump. |
| 4 | Most of the wax particles drop to the bottom as a partially dispersed clump after 1 tap. |
| 5 | Most of the wax particles drop to the bottom after 2-5 taps as free-flowing individual wax particles or as a partially dispersed clump. |
| 6 (fail) | The wax particles do not drop to the bottom after 5 taps or drop to the bottom as an intact mass. |

For 3.4-2.4 mm (6-8 mesh) wax particles, the ratio of the vial internal diameter to the average wax particle size was 7. For larger wax particles, larger glass vessels should be used, such that the ratio of the vial internal diameter to the average wax particle size is greater than 7.

The transportable products according to the present invention exhibit a passing stability rating when measured as described herein at 20° C. for 5 weeks.

Forming Wax Particles and the Transportable Product

The wax particles of the present invention may be produced from molten wax by any method known in the art, including, for example, cooling hot droplets of wax in a column of air, cooling hot droplets of wax in a liquid, or forming in a mold. Examples of equipment for forming and drying the wax particles are described in Perry's Chemical Engineers' Handbook, $4^{th}$ edition.

Wax particles can be formed by casting molten wax on a moving sheet to about 0.25-2" thick. To partially solidify the wax, it may be optionally cooled by spraying with water. The cast wax on the sheet is then cut into shapes by use of a rolling pin similar to a ravioli or maultaschen cutter. As wax particles with rough edges are not preferred because the edges may break, and form excessively small wax particles, the cut wax particles may be rolled down a slope, optionally with grooves, to shape the wax particles into spheres. The wax particles are then further cooled. Alternatively, molten wax may be cast into long tubes by extrusion and cut into smaller cylinders either with a rotating cutting wire or by simply bending over a curve. The smaller cylinders may be further shaped into spherical wax particles. Spheroidizing is another method of making wax particles.

Prilling towers and spray driers may be used to form wax particles by dropping molten wax through a cold gas. Prilling towers are preferred due to the tendency of spray driers to form wax buildup on the walls. As the formed wax particles fall, they at least partially solidify and can be collected in a liquid, that preferably will serve as the liquid for the transportable product. Design of the vessel to form wax particles of the appropriate size and stability when used in a transportable product is also important. Such designs, and methods for determining appropriate designs, would be within the knowledge of one skilled in the art. Sufficient cold gas should be used to cool the wax particles as the fall, but not so much as to cause turbulence which can result in wax particle fusion or breakup. The diameter and spacing of the nozzles and the temperature of the wax are also important to form droplets that have the desired size and shape.

Another method to form wax particles is to pass molten wax through a liquid. Water may be used, with water from a Fischer-Tropsch process that has been treated to reduce its acid content being preferred. The molten wax is injected into the bottom of a liquid-filled vessel through injector nozzles, forming droplets that float upward. The temperature of the bottom zone of the vessel is maintained at a temperature above that of the melting point of the wax, preventing the injector nozzles from plugging with wax. The liquid used toward the top of the vessel should be a cooled liquid. As the droplets rise and encounter cooler liquid (e.g., water), they are cooled and form wax particles. Cold nitrogen or other products from an air separation unit can be used to provide the cooled liquid, e.g., cooled water.

The transportable product at the top of the vessel can be removed by appropriate sluices, pumps, or screens. Important design parameters include the diameter and spacing of the injector nozzles and the temperatures of the wax and the liquid at different depths. Preferably, cold water is added to the top of the vessel, and as part of the cold water moves downward, it adsorbs the heat of fusion of the wax particles. The hot water exits the bottom of the vessel, and is cooled, recycled, and optionally purified. Cold nitrogen or other products from the air separation unit can be used to cool the hot water removed from the bottom of the vessel and provide cold water for recycling to the top of the vessel. The portion of the water added to the top of the vessel that does not move downward acts as a sluice to remove the formed wax particles. The wax particles and the extra water spill out of the vessel. If the liquid used to transport the wax particles comprises water, no further processing is needed. If the water content needs to be reduced, or if the wax particles are to be transported in a different liquid, the wax particles and water can be passed over a simple screen where the water can be removed and recycled to the vessel. The wax particles can be allowed to dry by contacting with air, and can then be added to the liquid used in the transport. Optionally, nitrogen from an air separation unit can be used to dry or cool the wax particles rather than air. Nitrogen from this source is ideal for drying as it has very low humidity and does not support combustion.

A limiting factor in the preparation of the wax particles can be the time for the particles to cool to a temperature at which they can be blended to form the transportable product, without the liquid partially dissolving the wax particles. Since wax has a relatively low thermal conductivity and the heat of fusion can be significant, it can take considerable time for the wax particles to cool. Thus, cooling requirements can lead to large equipment sizes and high capital costs. To speed the cooling and reduce equipment size, the wax particles may be formed from a mixture of molten wax and 10 and 80 weight % previously formed smaller wax particles. The size of the smaller wax particles should be from about 0.01-25% of the size of the larger wax particles to be formed and transported. These diameter sizes are average sizes, preferably determined as described herein using a sieve cloth. In forming the mixture, the molten wax is heated to a temperature above its melting point and the smaller wax particles added thereto. Upon mixing, the wax particles will heat and the molten wax will cool. The temperature of the mixture should be maintained within 5° C., preferably within 2° C., more preferably within 1° C., of the melting point of the wax. By maintaining the temperature of the mixture near that of the melting point of the wax, the molten wax does not solidify and the smaller wax particles do not melt. Once formed into large particles, the mixture of preformed wax particles has less heat of fusion to transfer through the surface of the large particle, thus it cools faster. In forming the mixture, it is difficult to heat the preformed particles to near the melting point of the wax; therefore, they can be kept at a cooler temperature while the molten wax is heated to just above its melting point. After heating the molten wax to just above its melting point, the preformed wax particles are mixed into the molten wax. Upon mixing, the wax particles will heat and the molten wax will cool, and thus, the mixture will be at the desired temperature.

The smaller wax particles do not need to be the same material as the molten wax. For example, the smaller wax particles can be a "softer" wax, that is, one that deforms more easily or that has a greater tendency to dissolve in the liquid to be used in the transportable product. If the smaller wax particles are a softer wax, the smaller wax particles are effectively coated with the molten wax (a "harder" wax) to form larger wax particles. These larger wax particles will resist dissolution in the liquid of the transportable product. Examples of softer wax include petroleum slack waxes, waxy petroleum crudes, fractions distilled from petroleum slack waxes and waxy petroleum crudes, and mixtures thereof. Examples of harder wax include Fischer-Tropsch derived waxes.

The smaller wax particles can be formed by any suitable method, as described above. In addition, other methods, that are not acceptable for forming the wax particles to be transported in the transportable product, can be used to form the smaller wax particles. These additional methods include methods such as spray drying, flash drying, or crushing, grinding and sieving larger pieces of wax. Furthermore, the smaller wax particles can be formed by cooling the wax to dry ice temperatures at which it fragments readily into fine particles. These methods form particles too small for the wax particles of the transportable product; however, the methods form particles acceptable for use as the smaller wax particles to then be used in forming the wax particles of the transportable product. In addition, the shape of the smaller wax particles is not critical, and it is not necessary that it be spherical or nearly spherical, as the smaller wax particles will be coated.

If the formation process for producing the waxy particles to be transported produces an excessive amount of fine material that will cause the transportable product to be unstable, the fines should be removed. The fines can be removed by conventional sieving operations done on either the transportable product or the dry solid wax particles. The recovered fines can be melted and processed again. It is preferable to minimize the formation of fines so that stable transportable products can be prepared without a fines removal step.

Examples of the equipment for forming and drying of the particles is described in Perry's Chemical Engineers' Handbook, $4^{th}$ edition.

The wax particles are added to the transportation liquid to provide the transportable product comprising 90 to 20 weight % liquid and 10 to 80 weight % wax particles, preferably 25 to 80 weight % wax particles, more preferably 28 to 80 weight % wax particles, and even more preferably 30 to 80 weight % wax particles. The wax particles may be added to the liquid of the transportable product by any suitable method, such methods may vary depending upon how the wax particles are formed. These methods are well within the skill of those in the art. The wax particles may be formed in the liquid of the transportable product and thus, a separate step for adding the wax particles to the liquid may not be required.

Transportation

The transportable product may be transported by any suitable means including, for example, via ship, pipeline, railroad car, or truck. For safe operation and ease of unloading, the liquid of the transportable product should have a flash point of greater than or equal to 60° C. and a true vapor pressure at 20° C. of less than or equal to 14.7 psia, preferably less than or equal to 11 psia, more preferably less than or equal to 9 psia.

Transportable products comprising wax particles in naphtha or water can be shipped in conventional crude takers with minor modifications. However for safe operation and ease of unloading, the naphtha must have a flash point of greater than or equal to 60° C. and a true vapor pressure at 20° C. of less than or equal to 14.7 psia, preferably less than or equal to 11 psia, more preferably less than or equal to 9 psia and an acid number of less than 1.5 mg KOH/g and preferably less than 0.5 mg KOH/g. Alcohols can be blended into the naphtha as a liquid for the transportable product and shipped in conventional crude tankers provided these specifications are met.

When water is used as the liquid, it will meet the True Vapor Pressure specification, and since it is non-combustible, the flash point specification will also be met. The key specification for water is that it have a pH>5, preferably >6.5.

Water-alcohols mixtures can also be used. If the flash point is >60° C., conventional crude tankers can be used; otherwise chemical grade tankers suitable for volatile liquids must be used.

Because dissolution of the wax particles into the liquid is a function of the temperature of the transportable product and of the liquid, it is important to maintain the temperature of the transportable product to an acceptable temperature during transportation. When the liquid is a hydrocarbonaceous liquid, for example naphtha, it is important to maintain the transportable product to a temperature that does not exceed 50° C., even for short periods of time. Preferably for hydrocarbonaceous liquids, the temperature of the transportable product is maintained such that it does not exceed 40° C., and more preferably such that it does not exceed 30° C. for a long period of time. Even more preferably when the liquid is a hydrocarbonaceous liquid, the temperature of the transportable product is maintained between about 10-30° C. While maintaining the temperature to less than or equal to 50° C. as described above, it is also important that the temperature not vary significantly. Accordingly, preferably the temperature is maintained such that it varies by less than 20° C. and more preferably, such that it varies by less than 10° C.

Although not as likely to dissolve in alcohol, water, or mixtures thereof, the wax particles can dissolve into heated alcohol, water, or alcohol/water mixtures. Accordingly, when the liquid comprises >50 weight % alcohol, ≧50 weight % water, and an alcohol/water mixture, it is important to maintain the transportable product at a temperature that does not exceed 65° C. and preferably does not exceed 50° C. While maintaining the temperature to less than or equal to 65° C. as described above, it is also important that the temperature not vary significantly. Accordingly, preferably the temperature is maintained such that it varies by less than 20° C. and more preferably, such that it varies by less than 10° C.

Ships used to transport the transportable product of the present invention may require some minor adaptations. For example, wax particles may remain on the bottom of the vessel once the transportable product has been pumped out. Such remaining wax particles can be removed by recirculating liquid, including, for example, Fischer-Tropsch light liquid products (i.e., Fischer-Tropsch condensate), other hydrocarbonaceous liquids such as diesel fuel, or water. Preferably, the liquid used to remove the residual wax particles should not contaminate the product with sulfur, nitrogen, or other undesirable species. Most preferably, Fischer-Tropsch light liquid products (i.e., Fischer-Tropsch condensate) recovered from the transportable product can be used to assist in removing traces of the wax particles from the bottom of the vessel. Also, to assist in evenly distributing the wax particles in the transportable product prior to and during pumping, some recirculation of the liquid to the bottom of the ship's tanks, especially near the inlet of the main product pump, may be desired.

Pumps used to transport slurries should not cause undue breakage of the particles as breakage can lead to the formation of small particles and unstable transportable products. Any number of pumps can be used provided that they do not cause such undue breakage. Examples of suitable pumps include Marcanaflo® Slurry Systems, centrifugal pumps, displacement pumps, and the like. In addition, a storage tank or ship that contains a transportable product according to the present invention can be unloaded by pressurizing the vessel with a gas and allowing the transportable product to discharge under the pressure induced in the vessel. Transportation tanks can also be placed on top of hills or other elevated locations, and the transportable product can be allowed to flow to the new location by gravity.

In preferred methods, a wax is made from a hydrocarbonaceous asset at a remote site and wax particles formed from this wax are transported to a developed site for conversion into salable finished products. In this process, the hydrocarbonaceous asset is converted into syngas and at least a portion of the syngas is converted into a product stream by a Fischer-Tropsch process. The product stream comprises paraffinic wax and a first hydrocarbonaceous liquid. The paraffinic wax is formed into wax particles. The wax particles are added to a liquid to provide a transportable product according to the present invention. Preferably, at least a portion of the liquid is also derived from the Fischer-Tropsch process. The liquid may be a hydrocarbonaceous liquid or an alcohol formed from the first hydrocarbonaceous product by a process selected from the group consisting of dehydration, decarboxylation, adsorption, hydrotreating, hydrocracking, and combinations thereof. The liquid may be water by-product from the Fischer-Tropsch process or water from the cooling water. The wax particles are added to the liquid to provide a transportable product according to the present invention comprising 90 to 20 weight % liquid and 10 to 80 weight % wax particles. The transportable product is shipped, while maintaining appropriate temperature and shipping conditions to ensure the stability of the transportable product, to a developed site. The transportable product is unloaded at the developed site and the transportable product is converted into salable finished products. The transportation liquid may also be separated and recovered for conversion into additional salable finished products.

In these processes, a portion of the syngas may also be converted into methanol by a methanol synthesis process and the methanol may be used to provide at least a portion of the liquid of the transportable product. In addition, the liquid of the transportable hydrocarbonaceous product may comprise a mixture of liquids all of which are derived from the Fischer-Tropsch process or from a Fischer-Tropsch process and a methanol synthesis process. As such, these mixtures may comprise methanol, naphtha, water, or mixtures thereof.

Separation

Upon receipt of the transportable product, the liquid and wax particles can be separated by a number of methods including, for example, filtration using simple screens, centrifugation, and heating, melting, and distillation. Preferred methods include heating, melting, and distillation.

Care must be taken when melting the transportable product. Initially the transportable product maintained at its transportation temperature (e.g., less than or equal to 50° C. for transportable products comprising hydrocarbonaceous liquids or less than or equal to 65° C. for transportable products comprising alcohol or water) is pumpable, and once it is hot such that it exceeds the melting point of the wax particles, it is also pumpable. However, at intermediate temperatures the wax particles can congeal and form a non-pumpable viscous semi-solid or solid. Therefore, use of heated pipelines to transport the transportable product is not preferred. In contrast, the pipelines should be maintained at temperatures appropriate for the transportable product, as described herein, and such that the temperature of the transportable product does not vary excessively, i.e., by less than 20° C. and more preferably, by less than 10° C. It may also be difficult to heat the transportable product as described herein via exchanges and furnaces due to the problems of forming a congealed semi-solid or solid mass. Therefore, the direct distillation of the transportable product according to the present invention by methods, as described in, for example, U.S. Pat. No. 6,294,076, may encounter problems and is not preferred.

A preferred method of separating the wax particles and liquid of the transportable product according to the present invention is illustrated in FIG. 1. This method melts the wax particles such that molten wax may be recovered by injecting the transportable product at its transportation temperature into molten wax. As illustrated, the transportable product is injected in a vessel containing molten wax. When injected the transportable product is maintained at its transportation temperature (e.g., less than or equal to 50° C., preferably 10-30° C., for hydrocarbonaceous liquids and less than or equal to 50° C. for alcohol and water). The molten wax in the vessel is maintained at a temperature greater than or equal to the melting point of the wax particles. Portions of the liquid of the transportable product may volatilize, and the vaporized liquid can be recovered. At least a portion of the molten wax can be removed from the vessel to provide wax for converting into finished salable products. The vaporized liquid may also be condensed and converted or upgraded into finished salable products.

In embodiments where the transportable product includes water, the water must be separated from the wax particles. Water may be separated from the transportable product by putting a screen over the water takeoff leg of a conventional density or American Petroleum Institute (API) separator, which will prevent the wax particles from being removed. Water is typically separated from products by conventional density (or API) separators.

In addition, the preferred method of separating the wax particles and liquid of the transportable product, as illustrated in FIG. 1, may be used when water is present in the transportable product. When water is present, pressure and temperature in the vessel are maintained such that the wax remains in a molten state and the water remains at least partially liquid. It is important to maintain at least a portion of the water as a liquid rather than boil the water, which can cause high heat loads and high vapor traffic. Vaporized liquid, including some water vapor, is recovered. At least a portion of the water in the liquid state is then separated from the molten wax and recovered by a conventional liquid-liquid separator equipped with an interface level control. At least a portion of the molten wax is recovered for conversion or upgrading into finished salable products.

Recovered wax can be used to produce diesel, jet fuel, lubricating base oils, blending components thereof, and finished waxes and by known technologies. Recovered naphtha can be used to produce gasoline, aromatics, or olefins, the latter by naphtha cracking. Recovered methanol, which may need to be purified, can be used in conventional methanol markets such as Methyl Tertiary Butyl Ether or as a solvent, reagent, or fuel. Recovered methanol can also be used to produce ethylene and propylene by reaction over a zeolite or phosphate containing molecular sieve. Methods for producing these finished salable products from recovered wax, recovered naphtha, and recovered methanol are well known to those of skill in the art.

Illustrative Embodiment

Figure 2:
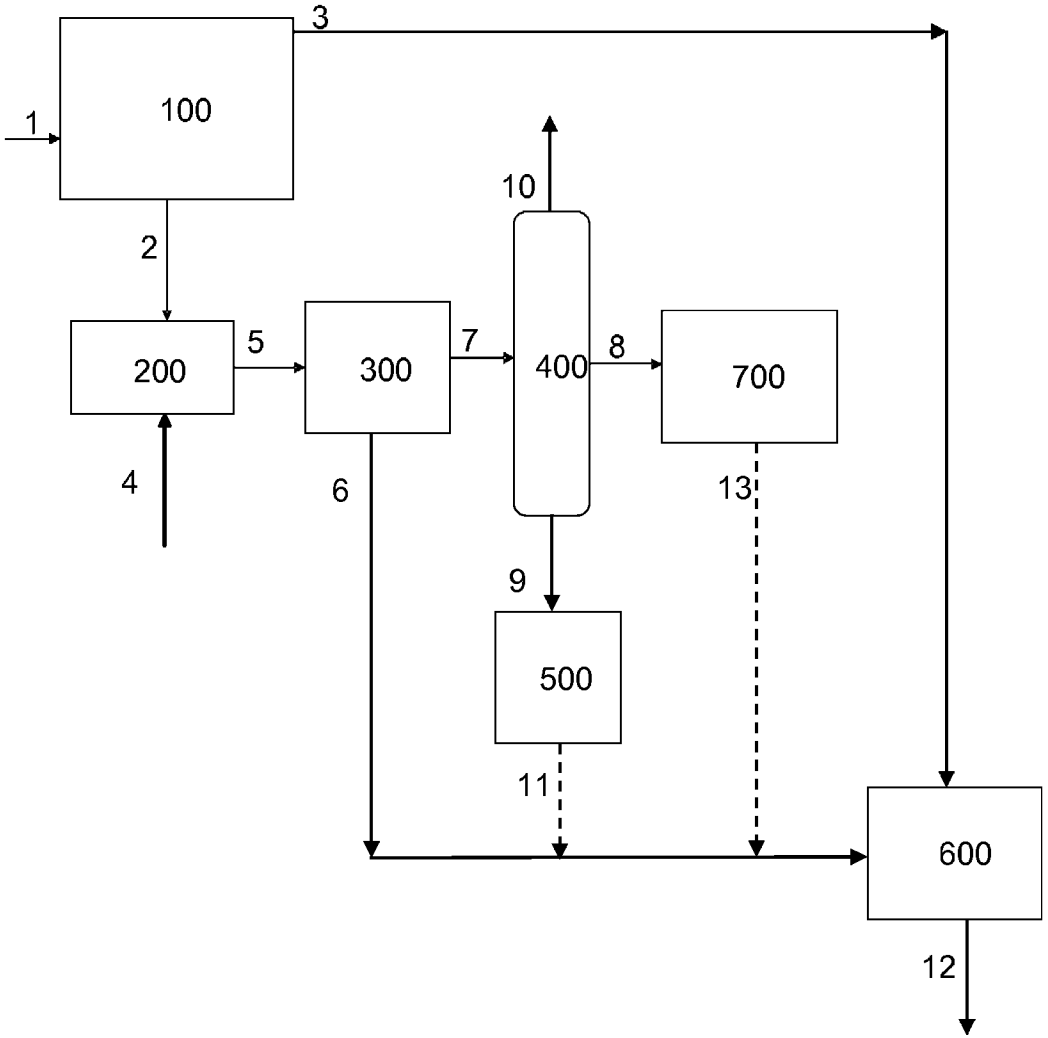
FIG. 2 illustrates an embodiment for providing a transportable product containing wax particles derived from a Fischer-Tropsch process.

According to a preferred embodiment of the present invention, illustrated in FIG. 2, at a remote site, air (1) is separated in an Air Separation Unit (100) to form oxygen (2) and cold nitrogen (3). The oxygen (2) is mixed with a methane-containing stream (4) along with steam (not shown) and recycled syngas (not shown) in a reformer (200) to produce syngas (5). The syngas (5) is reacted in a slurry bed Fischer-Tropsch Unit (300) using a cobalt catalyst to produce a liquid wax product (6) and a vapor phase (7). The vapor phase (7) is cooled and sent to a separator (400), which produces acidic water (8), acidic condensate (9) which has a flash point of greater than 60° F., and light products (10) that include unreacted syngas and butane, propane, and lighter hydrocarbons. The butane and propane are recovered and sold as such (not shown). The unreacted syngas is recycled to the Fischer-Tropsch unit (300) and the reformer (200) (not shown). The acidic condensate (9) is treated in a Condensate Treater (500) by passage over alumina at conditions including liquid hourly space velocity (LHSV) of 5 $hr^{-1}$, pressure of 50 psig and temperature of 680° F. to produce a treated condensate (11) that has an acid number of less than 0.5 mg KOH/g and a flash point of greater than 60° F. The treated condensate (11), liquid wax product (6), and cold nitrogen (3) are passed to a Particle Formation Unit (600), wherein the liquid wax product (6) is injected into the top of the unit (600) and allowed to fall downwards through the cold nitrogen (3). Treated condensate (11) is added at the bottom of the unit (300) and wax particles that are at least partially solidified fall into the treated condensate (11) to form a transportable product (12). The transportable product (12) of the treated condensate and the wax particles is removed and shipped to a developed site. The transportable product (12) has a passing stability rating when measured at 20° C. for 5 weeks. Heated nitrogen is removed from the top of the vessel (not shown) and vented or sent to flare.

Alternatively, the acidic water (8) may be treated in a water treatment unit (700) to form treated water (13) that has a pH of greater than 6.5. The treated water (13) is sent to the Particle Formation Unit (600) in place of the treated condensate (11). Wax particles are formed as described above, and they are dropped into the treated water (13) to form a transportable product (12) of treated water and wax particles.

EXAMPLES

The invention will be further explained by the following illustrative examples that are intended to be non-limiting.

Example 1

Fischer-Tropsch Acidic Distillates

From an economic standpoint, it is preferable to ship the wax particles using Fischer-Tropsch light products (condensates and naphthas) as the liquid rather than water or methanol. However, Fischer-Tropsch light products frequently contain oxygenates in the form of alcohols and acids. These can result in neutralization numbers greater than 0.5 mg KOH/g and potentially poor corrosion. These alcohols and acids were removed by dehydration and decarboxylation in the following experiments.

Two acidic distillates prepared by the Fischer-Tropsch process were obtained. The first (Feedstock A) was prepared by use of a iron catalyst. The second (Feedstock B) was prepared by use of a cobalt catalyst. The Fischer-Tropsch process used to prepare both feeds was operated in the slurry phase. Properties of the two feeds are shown below in Table IV to follow.

Feedstock A contains significant amounts of dissolved iron and is also olefinic. It has a significantly poorer corrosion rating.

For purposes of this invention, Feedstock B is preferable. It contains fewer oxygenates, has a lower acid content, and is less corrosive. Thus it is preferable to prepare olefinic distillate for use in blended fuels from cobalt catalysts rather than iron catalysts.

A modified version of ASTM D6550 (Standard Test Method for the Determination of the Olefin Content of Gasolines by Supercritical Fluid Chromatography—SFC) was used to determine the group types in the feedstocks and products. The modified method is to quantify the total amount of saturates, aromatics, oxygenates and olefins by making a 3-point calibration standard. Calibration standard solutions were prepared using the following compounds: undecane, toluene, n-octanol and dodecene. External standard method was used for quantification and the detection limit for aromatics and oxygenates is 0.1% wt and for olefins is 1.0% wt. Please refer to ASTM D6550 for instrument conditions.

A small aliquot of the fuel sample was injected onto a set of two chromatographic columns connected in series and transported using supercritical carbon dioxide as the mobile phase. The first column was packed with high surface area silica particles. The second column contained high surface area silica particles loaded with silver ions.

Two switching valves were used to direct the different classes of components through the chromatographic system to the detector. In a forward-flow mode, saturates (normal and branched alkanes and cyclic alkanes) pass through both columns to the detector, while the olefins are trapped on the silver-loaded column and the aromatics and oxygenates are retained on the silica column. Aromatic compounds and oxygenates were subsequently eluted from the silica column to the detector in a back flush mode. Finally, the olefins were back flushed from the silver-loaded column to the detector.

A flame ionization detector (FID) was used for quantification. Calibration was based on the area of the chromatographic signal of saturates, aromatics, oxygenates and olefins, relative to standard reference materials, which contain a known mass % of total saturates, aromatics, oxygenates and olefins as corrected for density. The total of all analyses was within 3% of 100% and normalized to 100% for convenience.

The weight % olefins can also be calculated from the bromine number and the average molecular weight by use of the following formula:

$$\text{Wt \% Olefins} = (\text{Bromine No.})(\text{Average Molecular Weight})/159.8.$$

It is preferable to measure the average molecular weight directly by appropriate methods, but it can also be estimated by correlations using the API gravity and mid-boiling point as described in "Prediction of Molecular Weight of Petroleum Fractions" A. G. Goossens, IEC Res. 1996, 35, p. 985-988.

Preferably the olefins and other components are measured by the modified SFC method as described above.

A GCMS analysis of the feedstocks determined that the saturates were almost exclusively n-paraffins, and the oxygenates were predominantly primary alcohols, and the olefins were predominantly primary linear olefins (alpha olefins).

Example 2

Dehydration and Decarboxylation Catalysts

Commercial Silica Alumina and Alumina extrudates were evaluated for dehydration and decarboxylation of the Acidic Naphthas from Example 1. Properties of the extrudates are shown below in Table III.

TABLE III

| | Extrudate | |
|---|---|---|
| | Silica Alumina | Alumina |
| Method of manufacture | 89% silica alumina powder bound with 11% alumina | Alumina extrudate |
| Particle Density, gm/cm$^3$ | 0.959 | 1.0445 |
| Skeletal Density, gm/cm$^3$ | 2.837 | |
| BET Surface area, m$^2$/g | 416 | 217 |
| Geometric Average pore size, Angstroms | 54 | 101 |
| Macropore volume, cc/g (1000+ Angstroms) | 0.1420 | 0.0032 |
| Total pore volume, cc/g | 0.636 | 0.669 |

Example 3

Dehydration and Decarboxylation Over Silica Alumina

The dehydration experiments were performed in one inch downflow reactors without added gas or liquid recycle. The catalyst volume was 120 cc.

The Fe-based condensate (Feed A) was treated with the commercial silica alumina. This catalyst was tested at 50 psig and temperatures of 480° F., 580° F., and 680° F. with the LHSV at 1 $hr^{-1}$ and 3 $hr^{-1}$. At a LHSV of 1 $hr^{-1}$, the total olefin content was 69-70% at all three temperatures, which indicated full conversion of the oxygenates. At 680° F. some cracking was observed by the light product yields: total C4—was 1.2% and C5—290° F. was 25% (vs. 20% in the feedstock). At a LHSV of 3 $hr^{-1}$ and 480° F. and 580° F., the total olefins were lower at 53-55%. High dehydration activity was obtained at 680° F. and a LHSV of 3 $hr^{-1}$ with total olefin content of 69%. GCMS data indicated that significant amount of 1-olefin was converted to internal or branched olefins. The total olefins at 480° F. was 69% initially but was 55% near the end of the test (~960 hours on stream). Significant amount of carbon was observed on the catalyst after unloading the catalyst. The catalyst apparently fouled.

TABLE IV

| Dehydration Si—Al catalyst | Temp, ° F. | LHSV, $hr^{-1}$ | Bromine method Bromine# | Bromine method % Olefin | GC-MS Data Alpha-olefins/ Total olefins |
|---|---|---|---|---|---|
| Sample A | | | 50.6 | 51.6 | 90% |
| Product D | 680 | 3 | 71.7 | 70.3 | 5% |
| | 680 | 1 | 72.2 | 70.5 | 6% |

The detailed analysis of the product (D) from the test at a LHSV of 3 $hr^{-1}$ and 680° F. is shown below in Table VI. 84% of the oxygen was removed, the corrosion rating was improved, and iron was reduced to below the level of detection. The acidity of the naphtha was reduced by 25%. The oxygenates were converted to olefins as shown by the increase in olefin content and the decrease in oxygenate content.

Example 4

Dehydration and Decarboxylation Over Alumina

The Co-based cold condensate (Feedstock B) was also treated as in Example 2, but with the alumina catalyst. Temperatures from 480° F. to 730° F. and LHSV values from 1 $hr^{-1}$ to 5 $hr^{-1}$ were explored. At high temperature and a LHSV of 1 $hr^{-1}$, GCMS data indicated that the double bond isomerization was significant (reduced alpha-olefin content). At a LHSV of 5 $hr^{-1}$ and 580° F., dehydration conversion was significantly lower, and the majority of the olefins were primary linear olefins. This test ran 2000 hours with no indication of fouling.

TABLE V

| Dehydration alumina catalyst Sample ID | Temp, ° F. | LHSV, $hr^{-1}$ | SFC method Oxygenates, % wt | Bromine method Bromine# | Bromine method % Olefin | GC-MS Data Alpha-olefins/ Total olefins | $C_{4-}$ Gas Yields, Wt % | Total Acid No. |
|---|---|---|---|---|---|---|---|---|
| Feed B: | | | 8.5 | 20.4 | 24.2 | 94% | | 0.86 |
| B1 | 480 | 1 | 7.4 | 21.3 | 25.2 | 92% | 0.32 | |
| B2 | 580 | 1 | 0.9 | 27.5 | 31.8 | 85% | <0.5 | |
| B3 | 580 | 1 | 0.8 | 28.2 | 33.1 | 91% | 0.34 | 0.6 |
| B4 | 580 | 1 | 0.9 | 27.1 | 31.1 | 93% | 0.36 | |
| B5 | 580 | 2 | 1.3 | 27.1 | 31.3 | 86% | <0.5 | |
| B6 | 580 | 3 | 2.1 | 26.5 | 30.6 | 86% | <0.5 | 0.48 |
| B7 | 630 | 1 | 0.6 | 27.9 | 32.2 | 78% | 0.46 | 0.32 |
| B8 | 630 | 2 | 0.8 | 28.1 | 32.4 | 79% | 0.38 | |
| B9 | 630 | 3 | 0.8 | 29.4 | 33.9 | 86% | 0.24 | 0.63 |
| B10 | 630 | 4 | 1.0 | 28.7 | 33.1 | 87% | 0.20 | |
| B11 | 630 | 5 | 1.1 | 27.1 | 31.1 | 83% | 0.18 | 0.67 |
| B12 | 680 | 1 | <0.1 | 31.1 | 35.6 | 4% | 0.51 | 0.06 |
| B13 | 680 | 2 | 0.3 | 26.7 | 30.8 | 30% | 0.40 | 0.18 |
| B14 | 680 | 3 | 0.5 | 26.5 | 30.6 | 71% | 0.33 | |
| B15 | 680 | 3 | 0.6 | 26.9 | 31.1 | 78% | <0.5 | |
| B16 | 680 | 4 | 0.6 | 27.6 | 32.0 | 76% | <0.5 | |
| B17 | 680 | 4 | 0.6 | 29.1 | 33.3 | 73% | 0.20 | |
| Product C | 680 | 5 | 0.7 | 28.1 | 32.3 | 78% | 0.18 | 0.39 |
| C1 | 680 | 5 | 0.7 | 27.8 | 31.9 | 79% | <0.5 | |
| C2 | 730 | 3 | 0.1 | 31.8 | 36.1 | 7% | 0.33 | 0.12 |

These results show that it is possible to eliminate all the oxygenates from the sample and convert them to olefins. At high oxygenate removal levels, a significant portion of the alpha olefins are isomerized to internal olefins, but this does not decrease their value as a distillate fuel or a distillate fuel blend component.

Product (C) was prepared from operation at a LHSV of 5 $hr^{-1}$ and 680° F. Detailed properties are shown below in Table VI. 87% of the oxygen is removed, the acidity was reduced by 55%, and the trace of iron in the sample was removed. The acidity of the final material was below 0.5 mg KOH/g, the typical maximum for petroleum crudes. The oxygenates were converted to olefins as shown by the increase in olefin content which approximately matched the decrease in oxygenate content.

TABLE VI

| | Experiment No. | | | |
|---|---|---|---|---|
| | 1 | 2 | 1 | 3 |
| | Feed/Product ID | | | |
| | Fe Cond. A | Product D | Co Cond. B | Product C |
| Process conditions | | | | |
| Catalyst | None | SiAl | None | Alumina |
| LHSV, $hr^{-1}$ | — | 3 | — | 5 |
| Temperature, ° F. | — | 680 | — | 680 |
| Pressure, psig | — | 50 | — | 50 |
| Run hours | — | 582-678 | — | 1026-1122 |
| API | 56.5 | 58.1 | 56.6 | 57.9 |
| Calculated Mol. Weight | 160 | 146 | 170 | 170 |
| Bromine No. | 50.6 | 71.7 | 21 | 27.6 |
| Average molecular weight | 163 | 157 | 183 | 184 |
| Wt % Olefin (calc. from $Br_2$ No.) | 51.6 | 70.3 | 24 | 32 |
| KF Water, ppm wt | 494 | 58 | 530 | 57 |
| Oxygen by NAA, wt % | 1.61 | 0.26 | 0.95 | 0.12 |
| SFC Analysis, Wt % | | | | |
| Saturates | 33.5 | 35.1 | 67.4 | 68.0 |
| Aromatics | 1.2 | 1.5 | 0.3 | 0.4 |
| Olefins | 55.7 | 62.2 | 23.7 | 30.9 |
| Oxygenates | 9.6 | 1.2 | 8.6 | 0.7 |
| Acid Test | | | | |
| Total Acid, mg KOH/g | 3.17 | 2.33 | 0.86 | 0.39 |
| Cu Strip Corrosion Rating | 2c | 2a | 1b | 1b |
| Sulfur, ppm wt | <1 | n/a | <1 | <1 |
| Nitrogen, ppm | 0.56 | n/a | 1.76 | 1.29 |
| ASTM D2887 Simulated Distillation by wt %, ° F. | | | | |
| 0.5 | 86 | 102 | 76 | 91 |
| 10 | 237 | 214 | 243 | 247 |
| 30 | 301 | 303 | 339 | 338 |
| 50 | 373 | 356 | 415 | 414 |
| 70 | 417 | 417 | 495 | 486 |
| 90 | 484 | 485 | 569 | 572 |
| 95 | 517 | 518 | 596 | 599 |
| 99.5 | 639 | 622 | 662 | 666 |
| Metals by ICP, ppm | | | | |
| Fe | 44.960 | 0.980 | 2.020 | <0.610 |
| Zn | 2.610 | <0.380 | <0.360 | <0.350 |

Metal elements below ICP limit of detection in all samples: Al, B, Ba, Ca, Cr, Cu, K, Mg, Mo, Na, Ni, P, Pb, S, Si, Sn, Ti, V.

Example 5

Adsorption of Oxygenates

Trace levels of oxygenates not removed by the high temperature treatment can be removed by adsorption using sodium X zeolite (commercial 13X sieve from EM Science, Type 13X, 8-12 Mesh Beads, Part Number MX1583T-1).

The adsorption test was carried out in a up-flow fixed bed unit. The feed for the adsorption studies was produced by processing the Co condensate (Feed B) over alumina at a LHSV of 5 $hr^{-1}$, 680° F., and 50 psig. The feed for the adsorption studies had acid number of 0.47 and oxygenate content by SFC of 0.6%.

Process conditions for the adsorption were: ambient pressure, room temperature, and a LHSV of 0.5 $hr^{-1}$. The oxygenate content of the treated products was monitored by the SFC method. The adsorption experiment was continued until breakthrough defined as the appearance of an oxygenate content of 0.1% or higher. The breakthrough occurred at when the sieve had adsorbed an equivalent amount of 14 wt % based on the feed and product oxygenates. The product after treatment showed 0.05 wt % oxygen by neutron activation, <0.1 ppm nitrogen, and total acid number of 0.09.

The adsorbent could be regenerated by known methods: oxidative combustion, calcinations in inert atmosphere, water washing, and the like, and in combinations.

These results demonstrate that adsorption processes can also be used for oxygenate removal. They can be used as such, or combined with dehydration.

Example 6

Preparation of Wax Particles

To test the effect of particle size on "pumpability" after storage for 5 weeks, a series of different Fischer-Tropsch wax particles were prepared by dropping untreated molten Fischer-Tropsch wax through air and then screening the wax particles into three size ranges; 6-8 mesh (3.4 mm to 2.4 mm), 24 to 40 mesh (0.7 mm to 0.4 mm), and smaller than 40 mesh (<0.4 mm) using stainless steels screens conforming to ASTM E11 specifications. To insure that the particles were properly formed and of the proper specified size and shape, the different size ranges were examined under a microscope. The particle size was measured using the calibrated eye piece of the microscope. As a preferred embodiment, all particles that did not appear to be spherical or semi-spherical were removed using tweezers. The particles in the 24 to 40 mesh range (0.7 mm to 0.4 mm) and <40 mesh range (<0.4 mm) were very spherical in shape. However, approximately 1% of the particles in the 6 to 8 mesh size (3.4 mm to 2.4 mm) range were flat disks where the ratio of the major to minor axis was greater than 3. There were also a very small percentage of particles in the screened 6 to 8 mesh size range that were composed of two fused particles. As a preferred embodiment, the particles that did not appear to be spherical or semi-spherical were removed, so that the remaining particles were spherical or semi-spherical in shape, where the ratio of the major to minor axis was less than 3. The average size of the 6-8 mesh particles is 2.9 mm.

The removal of particles that did not appear to be spherical or semi-spherical was done to provide experimental samples for use in determining the impact of particle size on transportable product stability. This removal procedure need not be done in the assessment of the percentage of wax particles that pass through a given mesh size in commercial samples.

Properties of the untreated Fischer-Tropsch wax are shown in Table VII.

TABLE VII

| Properties of Untreated Fischer-Tropsch Wax | |
|---|---|
| Property | Value |
| API Gravity | 40.3 |
| Nitrogen, ppm | 7.38 |
| Oxygen, wt % | 0.60 |
| Distillation by D2887, ° F. by wt % | |
| 0.5/5 wt % | 427/573 |
| 10/30 wt % | 625/736 |
| 50 wt % | 825 |
| 70/90 wt % | 926/1061 |
| 95/99 wt % | 1124/1221 |
| 99.5 wt % | 1245 |

Example 7

Test Procedure for Stability of Wax Particles in Liquids

Stability Test: For particles of 6-8 mesh and smaller, tests of stability of solutions of wax particles in liquids are preformed by the following method:

1. A prescribed amount of liquid was added via an eye dropper to the prescribed amount of the particles in an 8 dram Pyrex vial obtained from Fisher Scientific (25 mm OD×95 mm height, Catalog No 03-338). Care was taken not to vigorously move or shake the vial in any way that may cause motion of the liquid through and around the wax spheres.

2. The vial containing the transportable product was stored for 5 weeks at a prescribed temperature. During this time the vial was not moved.

3. Rating the stability of the mixture by inverting the vial and observing whether the particles drop to the bottom of the vial.

"Prescribed" refers to representative of the conditions of transport within the ranges as set forth herein. The prescribed amount of particles is the amount that will be transported and can range between 10 and 80%. In the experiments described next 50% is used which represents a typical maximum concentration. The temperature for the experiment can be varied, but 20° C. is the prescribed temperature as it reflects the typical temperatures during ocean voyages.

Satisfactory stability is obtained when the particles dropped within 3 seconds to the bottom, or when the majority of the particles drop to the bottom with less than five light taps where the light taps are generated by dropping the inverted vial from a height of 3 cm.

TABLE VIII

| Rating | Number | Preference | Description |
|---|---|---|---|
| Pass | 1 | Most preferred | All the particles drop or move within 5 seconds to the bottom as free-flowing individual particles. |
| Pass | 2 | Very more preferred | 90% or more of the particles drop to the bottom within 5 seconds as free-flowing particles after 1 tap. |
| Pass | 3 | More preferred | 90% or more of the particles drop within 5 seconds to the bottom as a partially dispersed clump containing at least 10 particles. |
| Pass | 4 | Preferred | 90% or more of the particles drop to the bottom within 5 seconds as a partially dispersed clump containing at least 10 particles after 1 tap. |
| Pass | 5 | Broad | 90% or more of the particles drop to the bottom within 5 seconds following a series of 2-5 taps as free-flowing individual particles or as a partially dispersed clump containing at least 10 particle. |
| Fail | 6 | | Less than 90% of the particles drop to the bottom after 5 taps or drops to the bottom as a single mass. |

For 6-8 mesh particles, the ratio of the internal diameter of the vial to the size of the average particles is 7. For larger wax particles, larger glass vessels should be used, but the ratio of the diameter of the vessel to the size of the particle should always be in excess of 7.

Example 8

Stability of 6-8 Mesh Particles in Low Acid Condensate

Three grams of the low acid condensate (product of Example 5) was added to three grams of wax particles in the 6 to 8 mesh range in an 8 dram Pyrex vial. The vial was then allowed to stand at 20° C. for 5 weeks. At which point the vial was turned upside down and after a light tap, most of the product slid down the vial. The rating was 2. The liquid naphtha was only slightly cloudy, thus indicating only a small amount of wax had dissolved into the condensate. This demonstrates that a 6 to 8 mesh size Fischer-Tropsch wax/condensate transportable product would remain pumpable for at least 5 weeks if stored at 20° C. The transportable product may need a gentle stirring just before pumping after it has been standing for a long period of time. These results demonstrate that a transportable product according to the present invention containing 50 wt % wax can be shipped, which is a significant improvement.

Example 9

Comparative Example

Stability of 24-40 Mesh Particles in Low Acid Condensate

Three grams of low acid condensate (product of Example 5) was added to 3 grams of 24 to 40 mesh size FT wax particles in an 8 dram vial, and then the vial allowed to stand at 20° C. for 5 weeks. At which point the vial was turned upside down and after 5 light taps, the product would not slide down the vial. The rating was a fail −6. The liquid naphtha between the particles was now a white solid. Due to the small particle size, too much wax had dissolved into the condensate over the 5 week period. It had gelled. This material could not be easily pumped without heating. This example illustrates the importance of wax particle size.

Example 10

Comparative Example

Stability of <40 Mesh Particles in Low Acid Condensate

Three grams of low acid condensate (product of Example 5) was added to 3 grams of the <40 mesh size FT wax particles in an 8 dram vial, and then the vial allowed to stand at 20° C. for 5 weeks. At which point the vial was turned upside down and after 5 light taps, the product would not slide down the vial. The rating was a fail −6. The liquid naphtha between the particles was now a white solid. Due to the small particle size, too much wax had dissolved into the condensate over the 5 week period. It had gelled. This material could not be easily pumped without heating. This example illustrates the importance of wax particle size.

Example 11

Comparative Example

Stability of 6-8 Mesh Particles in Low Acid Condensate at 50° C.

Three grams of the low acid condensate (product of Example 5) was added to 3 grams of spherical wax particles in the 6 to 8 mesh range in an 8 dram vial. The vial was then allowed to stand at 50° C. for 5 weeks. After cooling to room temperature, the vial was turned upside down and after 5 light taps, the product would not slide down the vial. The rating was a fail −6. Due to the higher temperature, the Fischer- Tropsch wax particles had completely dissolved into the naphtha to form a white solid. This material could not be easily pumped without heating. This example illustrates the importance of avoiding excessive temperatures during storage and shipment.

Example 12

Stability of 6-8 Mesh Particles in Methanol

Ten grams of methanol was added to 10 grams of 6-8 mesh size Fischer-Tropsch wax particles in an 8 dram vial, and allowed to stand for 7 weeks at 20° C. At which point in time the vial was turned upside down, and the transportable product immediately slid down the vial, thus demonstrating that this transportable product would remain pumpable. The rating was 1. This Example illustrates the importance of the composition of the liquid. As illustrated, methanol is less likely to dissolve the wax particles and thus, forms a more stable transportable product compared to transportable products comprising hydrocarbonaceous liquid. Methanol, water and mixtures thereof should form stable transportable products even when the particle size is very small. For these liquids, the particle size should be <25% through 140 mesh, preferably <10% through 140 mesh, more preferably <10% through 8 mesh, and even more preferably, <10% through 7 mesh.

Example 13

Stability of 6-8 Mesh Particles in Methanol-Water Mixture

Eight grams of methanol and two grams of water were added to 10 grams of 6-8 mesh size Fischer-Tropsch wax particles in an 8 dram vial, and allowed to stand for 7 weeks at 20° C. At which point the vial was turned upside down, and the transportable product immediately slid down the vial, thus demonstrating that this transportable product would remain pumpable. The rating was 1. This example illustrates the importance of the composition of the liquid and the wax particle size. With methanol-water mixtures smaller wax particles can be transported, and thus, may be preferable to hydrocarbonaceous liquids provided that the transportable product can be shipped in a vessel designed to handle liquids such as methanol with a closed-cup flash point less than 60° C.

Example 14

Stability of 6-8 Mesh Particles in Heated Methanol

The sample from Example 11 was placed in an oven at 50° C. for 1 day, and then cooled to room temperature. The methanol was no longer clear, indicating that some of the Fisher Tropsch wax had dissolved into the heated methanol, and upon cooling, the wax had precipitated out of solution. When the vial was turned upside down, a gentle tap was required to dislodge the particles. The rating was 2. This example demonstrates the importance of maintaining the temperature of the transportable product so that a methanol/wax transportable product is not heated above 50° C.

Example 15

Stability of 6-8 Mesh Particles in Heated Methanol-Water Mixture

The sample from Example 12 was placed in an oven at 50° C. for 1 day, and then cooled to room temperature. In contrast to Example 13, the methanol/water mixture was still clear, and when the vial was turned upside down the transportable product immediately slid down the vial. The rating was 1. This example demonstrated that methanol-water mixtures may be preferred over methanol if the transportable product will be exposed to a temperature above 50° C.

Example 16

Impact of Wax Particle Size on Stability of Condensate Wax Mixtures

A series of transportable products were prepared that contained three grams of low acid condensate (product of Example 5) and 3 grams of the FT wax particles in an 8 dram vial. The vial allowed to stand at 20° C. for 5 weeks and then evaluated in the stability test as described in Example 7.

TABLE IX

| Wax Particle Size | Rating after 5 weeks at 20° C. |
|---|---|
| 6-7 mesh (2.8 to 3.4 mm) | 2 |
| 7-8 mesh (2.4 to 2.8 mm) | 4 |
| 8-14 mesh (1.4 to 2.4 mm) | 6 failure |
| 8.3 wt % 30-48 mesh in 6-7 mesh | 5 |

These results demonstrate that stable mixtures of wax in condensate can be prepared provided that the amount of fine particles is not excessive. The last experiment is important. In the last experiment, 8.3 wt % of fine wax with a mesh size of 30-48 was added to a 6-7 mesh wax and the mixture was stable at 20° C. for 5 weeks. Additional fine material would not likely produce a stable mixture. Accordingly, the limit of the wax size for a transportable product comprising condensate as the liquid, can be established as less than or equal to 10 wt. % material smaller than 8 mesh (1.2 mm), preferably less than or equal to 10 wt % material smaller than 7 mesh (2.8 mm).

Example 17

Impact of Liquid Molecular Weight on Transportable Product Stability

Two lubricant base oils derived from Fischer-Tropsch wax were prepared. These lubricant base oils are isoparaffinic with very low heteroatom content. Properties are shown below.

TABLE X

Properties of Fischer-Tropsch Derived Base Oils

| Property | Base Oil A | Base Oil B |
|---|---|---|
| API Gravity, ° | 40.3 | 40.1 |
| Viscosity at 40° C. | 30.85 | 32.23 |
| Viscosity at 100° C. | 6.260 | 6.3620 |
| VI | 158 | 153 |
| Molecular Weight | 520 | 518 |
| Pour Point, ° C. | −12 | −23 |
| Simulated Distillation, D-2887, Wt % by ° F. | | |
| 0.5/5 | 832/853 | 828/847 |
| 10/30 | 863/892 | 856/881 |
| 50 | 915 | 905 |
| 70/90 | 938/967 | 931/962 |
| 95/99.5 | 979/1006 | 972/988 |

Transportable products were prepared consisting of 3 grams of lubricant base oil and 3 grams of wax particles prepared from Experiment 6. These transportable products were evaluated in the transportable product stability test at 5 weeks at 20° C. Results are shown in Table XI.

TABLE XI

Transportable Product Stability for Wax Particles in Lubricant Base Oil

| Wax Particle Size | Base Oil A | Base Oil B |
|---|---|---|
| 6-7 mesh (2.8 to 3.4 mm) | 5 | 4 |
| 8-14 mesh (1.4 to 2.4 mm) | 6 | 6 |

These results on 6-7 mesh particles are significantly poorer than those from Experiment 17 (rating of 2 versus a rating of 4 to 5) illustrating the importance of using low molecular weight hydrocarbonaceous liquids to form the transportable product. Accordingly, preferably the molecular weight of a hydrocarbonaceous liquid should be <600, more preferably <300, and even more preferably between 100 and 200.

Example 18

Stability of Small Mesh Size Wax Particles in Methanol

A sample of 30 to 40 mesh size Fischer-Tropsch wax particles were prepared according to the procedure described in Example 6. One gram of methanol was added to 1 gram of 30 to 40 mesh size Fischer-Tropsch wax particles in an 4 dram vial, and allowed to stand for 5 weeks at 20° C. At which point in time, the vial was turned upside down, and the transportable product immediately slid down the vial, thus demonstrating that this transportable product would remain pumpable. The rating was 1. This example demonstrates that significantly smaller mesh size wax particles can be used in forming a transportable products that is stable when methanol is used as the liquid compared to transportable products comprising a hydrocarbonaceous liquid.

While the present invention has been described with reference to specific embodiments, this application is intended to cover those various changes and substitutions that may be made by those of ordinary skill in the art without departing from the spirit and scope of the appended claims.

What is claimed is:

1. A transportable product comprising:

a) 70 to 20 weight % of a liquid comprising >50 weight % alcohol and water, and having a true vapor pressure of ≦14.7 psia when measured at 20° C.; and b) 30 to 80 weight % of wax particles, wherein the wax particles comprise ≧75 weight % of wax particles larger than 0.1 mm.

2. The product of claim 1, wherein the wax particles are selected from the group consisting of Fischer-Tropsch derived wax particles, petroleum derived wax particles, and combinations thereof.

3. The product of claim 1, wherein the wax particles are Fischer-Tropsch derived wax particles.

4. The product of claim 1, wherein the transportable product has a passing stability rating when measured at 20° C. for 5 weeks.

5. The product of claim 1, wherein the liquid has a true vapor pressure of ≦9 psia when measured at 20° C.

6. The product of claim 1, wherein at least a portion of the liquid is derived from a Fischer-Tropsch process.

7. The product of claim 1, wherein the alcohol is selected from the group consisting of methanol, ethanol, propanol, iso-propanol, butanol, t-butanol, and mixtures thereof.

8. The product of claim 7, wherein the alcohol is methanol.

9. The product of claim 8, wherein the liquid is a homogenous mixture of alcohol and water.

10. The product of claim 8, wherein the liquid comprises ≧90 weight % alcohol and ≦10 weight % water.

11. The product of claim 10, wherein the methanol is derived from a methanol synthesis process.

12. The product of claim 1, wherein the liquid further comprises a hydrocarbonaceous liquid selected from the group consisting of naphtha, heavy oil, distillate, lubricant base oil, and mixtures thereof.

13. The product of claim 1, wherein the liquid further comprises a naphtha selected from the group consisting of petroleum derived naphtha, Fischer-Tropsch derived naphtha, and mixtures thereof.

14. The product of claim 1, wherein the liquid comprises ≧95 weight % alcohol.

15. The product of claim 1, wherein the liquid comprises ≧95 weight % methanol.

16. The product of claim 1, wherein the liquid has a true vapor pressure of ≦9 psia when measured at 20° C.

17. The product of claim 1, wherein the wax particles are smaller than 50 mm.

18. The product of claim 17, wherein the wax particles comprise ≧90 weight % of wax particles larger than 0.1 mm.

19. The product of claim 17, wherein the wax particles comprise ≧90 weight % of wax particles larger than 2.8 mm.

20. The product of claim 1, wherein the wax particles are in the form of spheres, semi-spheres, flat disks, doughnuts, cylindrical extrudates, multilobe extrudates, and mixtures thereof.

* * * * *